US009592600B2

(12) United States Patent
Seith et al.

(10) Patent No.: US 9,592,600 B2
(45) Date of Patent: Mar. 14, 2017

(54) ANGLE IMPACT TOOLS

(71) Applicant: Ingersoll-Rand Company, Davidson, NC (US)

(72) Inventors: Warren Andrew Seith, Bethlehem, PA (US); Lucas James Taylor, Easton, PA (US); Mark T. McClung, Andover, NJ (US); Kenneth James Zimmer, Freehold, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 323 days.

(21) Appl. No.: 14/251,552

(22) Filed: Apr. 11, 2014

(65) Prior Publication Data

US 2014/0216775 A1 Aug. 7, 2014

Related U.S. Application Data

(63) Continuation-in-part of application No. 13/033,241, filed on Feb. 23, 2011, now Pat. No. 8,925,646.

(51) Int. Cl.
*B25F 5/02* (2006.01)
*B25B 21/02* (2006.01)

(52) U.S. Cl.
CPC ..... *B25F 5/02* (2013.01); *B25B 21/026* (2013.01)

(58) Field of Classification Search
CPC ..... B25F 5/001; B25B 21/00; B25B 13/467; B25B 13/481; B25B 17/00; B25B 21/002; B25B 21/02; B25B 21/026; B25B 23/1475

(Continued)

(56) References Cited

U.S. PATENT DOCUMENTS 2,267,781 A 12/1941 Albertson
2,585,486 A 2/1952 Mitchell (Continued)

FOREIGN PATENT DOCUMENTS

CN 1318451 A 10/2001
CN 1494988 A 5/2004

(Continued)

OTHER PUBLICATIONS

Ingersoll Rand Company, "2015MAX and 2025MAX Series Angle Air Impactool—Exploded View", May 2010, 2 pages.

(Continued)

*Primary Examiner* — Michelle Lopez
(74) *Attorney, Agent, or Firm* — Barnes & Thornburg LLP

(57) ABSTRACT

In at least one illustrative embodiment, an angle impact tool may comprise a handle assembly extending along a first axis and supporting a motor, the motor including a shaft configured to rotate about the first axis, and a work attachment coupled to the handle assembly. The work attachment may comprise an impact mechanism including an anvil configured to rotate about a second axis that is non-parallel to the first axis and a hammer configured to rotate about the second axis to periodically deliver an impact load to the anvil, a gear assembly configured to transfer rotation from the shaft of the motor to the hammer of the impact mechanism, and a housing supporting the impact mechanism and the gear assembly. The housing may be partitioned along a first parting plane that is perpendicular to the second axis such that the housing includes first and second housing sections.

17 Claims, 15 Drawing Sheets

(58) Field of Classification Search
USPC ..... 173/109, 217, 216
See application file for complete search history.

(56) References Cited

U.S. PATENT DOCUMENTS

| | | | | |
|---|---|---|---|---|
| 3,181,672 | A | | 5/1965 | Swanson |
| 3,223,182 | A | | 12/1965 | Mikiya |
| 3,270,593 | A | | 9/1966 | Kaman |
| 3,352,368 | A | | 11/1967 | Maffey, Jr. |
| 3,380,539 | A | | 4/1968 | Kaman |
| 3,465,646 | A | | 9/1969 | Kiester et al. |
| 3,661,217 | A | | 5/1972 | Maurer |
| 3,848,680 | A | | 11/1974 | Legler |
| 3,949,944 | A | | 4/1976 | Bent |
| 3,951,217 | A | | 4/1976 | Wallace et al. |
| 4,173,828 | A | | 11/1979 | Lustig et al. |
| D256,980 | S | | 9/1980 | Adams et al. |
| 4,222,443 | A | | 9/1980 | Chromy |
| 4,235,850 | A | | 11/1980 | Otto, Jr. |
| 4,287,795 | A | | 9/1981 | Curtiss |
| 4,355,564 | A | | 10/1982 | Gidlund |
| 4,379,492 | A | | 4/1983 | Hiraoka |
| 4,403,679 | A | | 9/1983 | Snider |
| 4,434,858 | A | | 3/1984 | Whitehouse |
| 4,488,604 | A | | 12/1984 | Whitehouse |
| 4,585,078 | A | | 4/1986 | Alexandrov et al. |
| 4,625,999 | A | | 12/1986 | Valentine et al. |
| 4,708,210 | A | | 11/1987 | Rahm |
| 4,719,976 | A | | 1/1988 | Bleicher et al. |
| 4,732,218 | A | | 3/1988 | Neumaier et al. |
| 4,735,020 | A | | 4/1988 | Schulz et al. |
| 4,740,144 | A | | 4/1988 | Biek |
| 4,776,561 | A | | 10/1988 | Braunlich et al. |
| 4,779,382 | A | | 10/1988 | Rudolf et al. |
| 4,798,249 | A | | 1/1989 | Hoereth et al. |
| 4,799,833 | A | | 1/1989 | Pennison et al. |
| 4,867,250 | A | | 9/1989 | Ono |
| 4,974,475 | A | * | 12/1990 | Lord ..... B25B 21/004 81/57.13 |
| 5,022,469 | A | | 6/1991 | Westerberg |
| D323,961 | S | | 2/1992 | Fushiya et al. |
| 5,143,161 | A | | 9/1992 | Vindez |
| D335,808 | S | | 5/1993 | Bruno et al. |
| 5,210,918 | A | | 5/1993 | Wozniak et al. |
| D339,726 | S | | 9/1993 | Bruno et al. |
| 5,293,747 | A | | 3/1994 | Geiger |
| 5,346,021 | A | | 9/1994 | Braunlich |
| 5,346,024 | A | | 9/1994 | Geiger et al. |
| D352,645 | S | | 11/1994 | Ichikawa |
| 5,443,196 | A | | 8/1995 | Burlington |
| 5,471,898 | A | | 12/1995 | Forman |
| 5,505,676 | A | | 4/1996 | Bookshar |
| D372,850 | S | | 8/1996 | Dubuque et al. |
| 5,626,198 | A | | 5/1997 | Peterson |
| D380,949 | S | | 7/1997 | Sung |
| D388,678 | S | | 1/1998 | Bantly et al. |
| D393,580 | S | | 4/1998 | Bantly et al. |
| 5,813,477 | A | | 9/1998 | Clay et al. |
| D400,771 | S | | 11/1998 | Smith et al. |
| D403,564 | S | | 1/1999 | Izumisawa |
| 5,906,244 | A | | 5/1999 | Thompson et al. |
| D414,093 | S | | 9/1999 | Zurwelle |
| 6,039,231 | A | | 3/2000 | White |
| 6,044,917 | A | | 4/2000 | Brunhoelzl |
| 6,047,779 | A | | 4/2000 | Wallace |
| 6,053,080 | A | | 4/2000 | Kaneyama et al. |
| 6,082,468 | A | | 7/2000 | Pusateri et al. |
| 6,109,366 | A | | 8/2000 | Jansson et al. |
| D434,297 | S | | 11/2000 | Iritani et al. |
| D434,958 | S | | 12/2000 | Izumisawa |
| 6,158,459 | A | | 12/2000 | Chang |
| D436,818 | S | | 1/2001 | Izumisawa |
| 6,179,063 | B1 | | 1/2001 | Borries et al. |
| D437,760 | S | | 2/2001 | Izumisawa |
| D441,628 | S | | 5/2001 | Bass et al. |
| 6,250,399 | B1 | | 6/2001 | Giardino |
| D444,363 | S | | 7/2001 | Hayakawa et al. |
| D447,029 | S | | 8/2001 | Sun et al. |
| 6,338,389 | B1 | | 1/2002 | Chang |
| D454,475 | S | | 3/2002 | Taga |
| D458,824 | S | | 6/2002 | Chen |
| D461,110 | S | | 8/2002 | Izumisawa |
| 6,460,629 | B2 | | 10/2002 | Bookshar et al. |
| 6,461,088 | B2 | | 10/2002 | Potter et al. |
| D465,982 | S | | 11/2002 | Taga |
| 6,491,111 | B1 | | 12/2002 | Livingston et al. |
| 6,502,485 | B1 | | 1/2003 | Salazar |
| 6,505,690 | B2 | | 1/2003 | Tokunaga |
| D469,673 | S | | 2/2003 | Silker et al. |
| D472,782 | S | | 4/2003 | Pusateri et al. |
| 6,561,284 | B2 | | 5/2003 | Taga |
| D476,210 | S | | 6/2003 | Chen |
| D476,870 | S | | 7/2003 | Hayakawa et al. |
| D477,512 | S | | 7/2003 | Liu et al. |
| 6,691,798 | B1 | | 2/2004 | Lindsay |
| 6,708,779 | B2 | | 3/2004 | Taga |
| 6,719,067 | B2 | | 4/2004 | Taga |
| 6,782,956 | B1 | | 8/2004 | Seith et al. |
| D496,243 | S | | 9/2004 | Huang |
| 6,789,447 | B1 | | 9/2004 | Zinck |
| 6,796,385 | B1 | | 9/2004 | Cobzaru et al. |
| D497,529 | S | | 10/2004 | Price |
| D497,785 | S | | 11/2004 | Izumisawa |
| D497,787 | S | | 11/2004 | Liao |
| D502,071 | S | | 2/2005 | Snider |
| 6,863,134 | B2 | | 3/2005 | Seith et al. |
| 6,863,135 | B2 | | 3/2005 | Kamimura et al. |
| 6,880,645 | B2 | | 4/2005 | Izumisawa |
| 6,883,619 | B1 | | 4/2005 | Huang |
| 6,889,778 | B2 | | 5/2005 | Colangelo, III et al. |
| 6,929,074 | B1 | | 8/2005 | Lai |
| 6,935,437 | B2 | | 8/2005 | Izumisawa |
| D510,513 | S | | 10/2005 | Aglassinger |
| 6,957,706 | B2 | | 10/2005 | Burger et al. |
| D511,284 | S | | 11/2005 | Henssler et al. |
| 6,968,908 | B2 | | 11/2005 | Tokunaga et al. |
| D519,807 | S | | 5/2006 | Chen |
| D521,339 | S | | 5/2006 | Chen |
| 7,036,605 | B2 | | 5/2006 | Suzuki et al. |
| 7,036,795 | B2 | | 5/2006 | Izumisawa |
| 7,040,414 | B1 | | 5/2006 | Kuo |
| D525,502 | S | | 7/2006 | Chen |
| 7,080,578 | B2 | | 7/2006 | Izumisawa |
| 7,089,833 | B2 | | 8/2006 | Hamann et al. |
| 7,109,675 | B2 | | 9/2006 | Matsunaga et al. |
| D529,353 | S | | 10/2006 | Wong et al. |
| D530,171 | S | | 10/2006 | Baker |
| 7,137,457 | B2 | | 11/2006 | Frauhammer et al. |
| 7,140,179 | B2 | | 11/2006 | Bass et al. |
| D534,047 | S | | 12/2006 | Chi |
| D535,536 | S | | 1/2007 | Ghode et al. |
| 7,174,971 | B1 | | 2/2007 | Chen |
| 7,191,849 | B2 | | 3/2007 | Chen |
| D540,134 | S | | 4/2007 | Clay |
| D540,640 | S | | 4/2007 | Clay |
| 7,311,155 | B2 | | 12/2007 | Chang |
| D569,206 | S | | 5/2008 | Takahagi et al. |
| D572,991 | S | | 7/2008 | Chen |
| D580,248 | S | | 11/2008 | Rane et al. |
| 7,461,704 | B2 | | 12/2008 | Chen |
| D587,080 | S | | 2/2009 | Rane et al. |
| 7,492,125 | B2 | | 2/2009 | Serdynski et al. |
| D590,226 | S | | 4/2009 | Chu |
| D590,680 | S | | 4/2009 | Cole et al. |
| D590,681 | S | | 4/2009 | Palermo et al. |
| D591,127 | S | | 4/2009 | Taga |
| 7,537,064 | B2 | | 5/2009 | Milbourne et al. |
| D610,888 | S | | 3/2010 | Izumisawa et al. |
| D617,620 | S | | 6/2010 | Yaschur et al. |
| 7,770,660 | B2 | | 8/2010 | Schroeder et al. |
| 7,779,931 | B2 | | 8/2010 | Townsan |
| D624,380 | S | | 9/2010 | Rane et al. |
| 7,828,072 | B2 | | 11/2010 | Hashimoto et al. |
| 7,836,797 | B2 | | 11/2010 | Hecht et al. |

(56) References Cited

U.S. PATENT DOCUMENTS

| | | | |
|---|---|---|---|
| 7,886,840 | B2 | 2/2011 | Young et al. |
| 8,267,192 | B2 | 9/2012 | Lopano et al. |
| 8,297,373 | B2 | 10/2012 | Elger et al. |
| 8,319,379 | B2 | 11/2012 | Onose et al. |
| 8,347,979 | B2 | 1/2013 | Young et al. |
| 8,925,646 | B2 | 1/2015 | Seith |
| 2002/0035890 | A1 | 3/2002 | Kusachi et al. |
| 2003/0075348 | A1 | 4/2003 | Eardley et al. |
| 2004/0014411 | A1 | 1/2004 | Jonas |
| 2004/0177980 | A1 | 9/2004 | Lucas |
| 2005/0161243 | A1 | 7/2005 | Livingston et al. |
| 2005/0279196 | A1 | 12/2005 | Hollar |
| 2005/0279519 | A1 | 12/2005 | Clark |
| 2006/0090914 | A1 | 5/2006 | Lin et al. |
| 2006/0107798 | A1 | 5/2006 | Falzone |
| 2007/0000674 | A1 | 1/2007 | Sell et al. |
| 2007/0181322 | A1 | 8/2007 | Hansson et al. |
| 2007/0282345 | A1 | 12/2007 | Yedlicka et al. |
| 2007/0289760 | A1 | 12/2007 | Sterling et al. |
| 2008/0066937 | A1 | 3/2008 | Kobayashi |
| 2008/0289843 | A1 | 11/2008 | Townsan |
| 2009/0038816 | A1 | 2/2009 | Johnson et al. |
| 2009/0272554 | A1 | 11/2009 | Young et al. |
| 2009/0272556 | A1 | 11/2009 | Young et al. |
| 2010/0107423 | A1 | 5/2010 | Bodine et al. |
| 2010/0269646 | A1 | 10/2010 | Le Du et al. |
| 2010/0276168 | A1 | 11/2010 | Murthy et al. |
| 2011/0139474 | A1 | 6/2011 | Seith et al. |
| 2011/0233257 | A1 | 9/2011 | Fukinuki et al. |
| 2012/0118596 | A1 | 5/2012 | Scott |
| 2012/0138329 | A1 | 6/2012 | Sun et al. |
| 2012/0152580 | A1 | 6/2012 | Mattson et al. |
| 2012/0211249 | A1 | 8/2012 | Seith et al. |
| 2013/0025900 | A1 | 1/2013 | Kokinelis et al. |
| 2014/0008090 | A1 | 1/2014 | Kokinelis et al. |
| 2014/0014385 | A1 | 1/2014 | Kosugi et al. |
| 2014/0216776 | A1 | 8/2014 | Seith |
| 2014/0262396 | A1 | 9/2014 | McClung |
| 2014/0274526 | A1 | 9/2014 | McClung |

FOREIGN PATENT DOCUMENTS

| | | | |
|---|---|---|---|
| CN | 101856811 | | 10/2010 |
| CN | 201702726 | | 1/2011 |
| CN | 103608149 | | 2/2014 |
| EP | 1138442 | | 10/2001 |
| EP | 2277469 | A2 | 5/2005 |
| EP | 2174754 | A1 | 4/2010 |
| JP | 3248296 | B2 | 10/1994 |
| JP | 0911140 | A | 1/1997 |
| JP | 3372398 | B2 | 1/1997 |
| JP | 2001198853 | A | 7/2011 |
| JP | 2013 000869 | A | 1/2013 |
| WO | 99/49553 | A1 | 9/1999 |
| WO | WO 2007/063106 | A1 | 6/2007 |
| WO | 2011002855 | A1 | 1/2011 |
| WO | 2011/111850 | A1 | 9/2011 |
| WO | 2012/115921 | A2 | 8/2012 |
| WO | WO 2012/115921 | A2 | 8/2012 |

OTHER PUBLICATIONS

Makita U.S.A., Inc "18V LXT Lithium-Ion Cordless 3/8' Angle Impact Wrench, Model BTL063Z: Parts Breakdown", Jul. 2007, 1 page.

International Preliminary Examining Authority, International Preliminary Report on Patentability for PCT/US2012/25850, mailed on Sep. 13, 2013, 27 pages.

State Intellectual Property Office of the People's Republic of China, First Office Action for CN200810188483.7, Dec. 25, 2012 (10 pages including English translation).

United States Patent & Trademark Office, Office Action for U.S. Appl. No. 13/033,217, mailed Jan. 4, 2013, 12 pages.

International Searching Authority, International Search Report and Written Opinion for PCT/US2012/25850, mailed on Dec. 26, 2012, 8 pages.

Photographs of pneumatic tools, published prior to Apr. 18, 2006, 5 pages.

Stanley Air Tools Valve, published prior to May 5, 2008, 3 pages.

Hitachi Power Tools, "Electric Tool Parts List, Cordless Angle Impact Driver, Model WH 10DCL," Aug. 29, 2008, 20 pages.

Makita Corporation, "Cordless Angle Impact Drivers, Model 6940D, 6940DW," publicly available at least as early as Sep. 28, 2010, 27 pages.

Sears Brands Management Corporation, "Operator's Manual, Craftsman Nextec, 12.0-Volt Lithium-Ion Cordless Right-Angle Impact Driver, Model No. 320.17562," 15 pages.

European Patent Application No. 15162794.0; European Search Report Dated Nov. 9, 2015.

China Patent Application No. 201510173007.8; Chinese Office Action Dated Aug. 1, 2016.

U.S. Appl. No. 14/251,567; U.S. Office Action Dated May 12, 2016.

* cited by examiner

ANGLE IMPACT TOOLS

CROSS-REFERENCE TO RELATED APPLICATION

This application is a continuation-in-part of U.S. patent application Ser. No. 13/033,241, filed Feb. 23, 2011 (entitled "Right Angle Impact Tool"), the entire disclosure of which is incorporated by reference herein.

TECHNICAL FIELD

The present disclosure relates, generally, to angle impact tools and, more particularly, to work attachment housings for such tools.

BACKGROUND

Many power tools that are used for tightening and loosening fasteners have difficulty fitting in tight spaces. In particular, existing impact tools may not be able to reach certain fasteners due to the size and/or orientation of the tool head and the output drive. In contrast, many tools that do fit in tight spaces may not be able to accomplish tightening and loosening of fasteners effectively and/or safely.

Various impact tools have been proposed in an attempt to address the foregoing concerns. Impact tools generally include a motor coupled to an impact mechanism that converts torque provided by the motor into a series of powerful rotary blows directed from one or more hammers to an anvil that is integrally formed with (or otherwise drives rotation of) an output drive of the impact tool. In angle impact tools, the output drive typically rotates about an output axis that is non-parallel to a motor axis about which an output shaft of the motor rotates.

The housing that supports the output drive, the impact mechanism, and other drive train components of existing angle impact tools has typically had a "clamshell" construction, in which the housing is partitioned into two sections along a parting plane that is parallel to both the output axis and the motor axis of the tool (e.g., a parting plane similar to the cross-section planes used in FIGS. 4, 7, and 10 of the present disclosure). However, this "clamshell" construction of the housing can result in poor alignment of the various drive train components, as well as difficulty in assembling and/or servicing the angle impact tool.

SUMMARY

According to one aspect, an angle impact tool may comprise a handle assembly extending along a first axis and supporting a motor, where the motor includes a shaft configured to rotate about a first axis, and a work attachment coupled to the handle assembly. The work attachment may comprise an impact mechanism including an anvil configured to rotate about a second axis that is non-parallel to the first axis and a hammer configured to rotate about the second axis to periodically deliver an impact load to the anvil to cause rotation of the anvil about the second axis, a gear assembly configured to transfer rotation from the shaft of the motor to the hammer of the impact mechanism, and a housing supporting the impact mechanism and the gear assembly. The housing may be partitioned along a first parting plane that is perpendicular to the second axis such that the housing includes a first housing section and a second housing section.

In some embodiments, the first axis may be parallel to the first parting plane. The first axis may lie in the first parting plane. In other embodiments, the first axis may be spaced apart from the first parting plane. The first axis may intersect the second axis between (i) a position of the anvil along the second axis and (ii) a point at which the second axis intersects the first parting plane. In other embodiments, the first parting plane may intersect the second axis between (i) a position of the anvil along the second axis and (ii) a point at which the second axis intersects the first axis. The first and second housing sections may also be partitioned along a second parting plane that is perpendicular to the first axis.

In some embodiments, the second housing section may be removably coupled to the first housing section by a plurality of fasteners. Each of the plurality of fasteners may extend through a corresponding aperture formed in the second housing section and may be received in a corresponding bore formed in the first housing section. Each of the corresponding apertures formed in the second housing section may be recessed from an exterior profile of the second housing section such that each of the plurality of fasteners that removably couples the second housing section to the first housing section does not extend beyond the exterior profile of the second housing section. The angle impact tool may further comprise a gasket positioned between the first and second housing sections to provide a fluid seal when the second housing section is removably coupled to the first housing section by the plurality of fasteners.

In some embodiments, the first housing section may be formed to include a first bore extending along the first axis, a second bore extending along the second axis, and a third bore extending along a third axis that is parallel to the second axis. The third bore may be positioned between the first and second bores and overlap both the first and second bores. The impact mechanism may be positioned in the second bore. The gear assembly may be positioned at least partially within the first and third bores. The second housing section may be formed to include a fourth bore extending along the second axis and a fifth bore extending along the third axis.

In some embodiments, the work attachment may further comprise a plurality of pins that each extend into a corresponding bore formed in the first housing section and into a corresponding bore formed in the second housing section, such that the plurality of pins align the fourth bore with the second bore and the fifth bore with the third bore. The first housing section may be formed to include a shoulder that protrudes toward the second housing section, and the second housing section may be formed to include a lip that protrudes toward the first housing section. The lip may engage the shoulder such that the fourth bore is aligned with the second bore and the fifth bore is aligned with the third bore.

In some embodiments, the gear assembly may include a first bevel gear positioned in the first bore of the first housing section and configured to rotate about the first axis and a second bevel gear positioned in the third bore of the first housing section and configured to rotate about the third axis, where the second bevel gear meshes with the first bevel gear. The first bore may comprise adjacent first and second bore sections. The second bore section may have a smaller diameter than the first bore section and may be located closer to the third bore than the first bore section. The first bore section may be bounded by a first internal surface of the first housing section, and the second bore section may be bounded by a second internal surface of the first housing section. The first bevel gear may include a shaft that extends along the first axis and comprises adjacent first and second shaft sections. The second shaft section may have a larger diameter than the first shaft section. The first shaft section may be positioned within the first bore section, and the second shaft section may be positioned within the second bore section. A bearing may support the first bevel gear for rotation about the first axis and engages both the first shaft section and the first internal surface. The bearing may abut both the second shaft section and the second internal surface to align the first and second bevel gears.

In some embodiments, the work attachment may be removably coupled to the handle assembly by a plurality of fasteners. Each of the plurality of fasteners may extend through a corresponding aperture formed in the first housing section and may be received in a corresponding bore formed in the handle assembly. Each corresponding bore extending along an axis may be disposed at an acute angle to the first axis.

According to another aspect, a work attachment may comprise a housing body configured to be coupled to a motorized tool including a rotatable output shaft, where the housing body is formed to include (i) a first bore extending along a first axis, (ii) a second bore extending along a second axis that is perpendicular to the first axis, and (iii) a third bore extending along a third axis that is perpendicular to the first axis, the third bore being positioned between the first and second bores and overlapping both the first and second bores. The work attachment may further comprise an impact mechanism received in the second bore of the housing body, the impact mechanism including a hammer configured to rotate about the second axis to periodically deliver an impact load to an anvil to cause rotation of the anvil about the second axis. The work attachment may further comprise a gear assembly received at least partially in the first and third bores of the housing body, where the gear assembly is configured to be coupled to the rotatable output shaft of the motorized tool such that rotation of the output shaft about the first axis drives rotation of the hammer about the second axis. The work attachment may further comprise a housing cap removably coupled to the housing body by a plurality of fasteners to enclose the second and third bores, where the housing cap abuts the housing body along a first parting plane that is perpendicular to the second and third axes.

In some embodiments, the housing cap may also abut the housing body along a second parting plane that is perpendicular to the first axis. The second parting plane may be located between the third axis and an end of the housing body configured to be coupled to the motorized tool.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. The detailed description particularly refers to the accompanying figures in which.

DETAILED DESCRIPTION OF THE DRAWINGS

Figure 1:
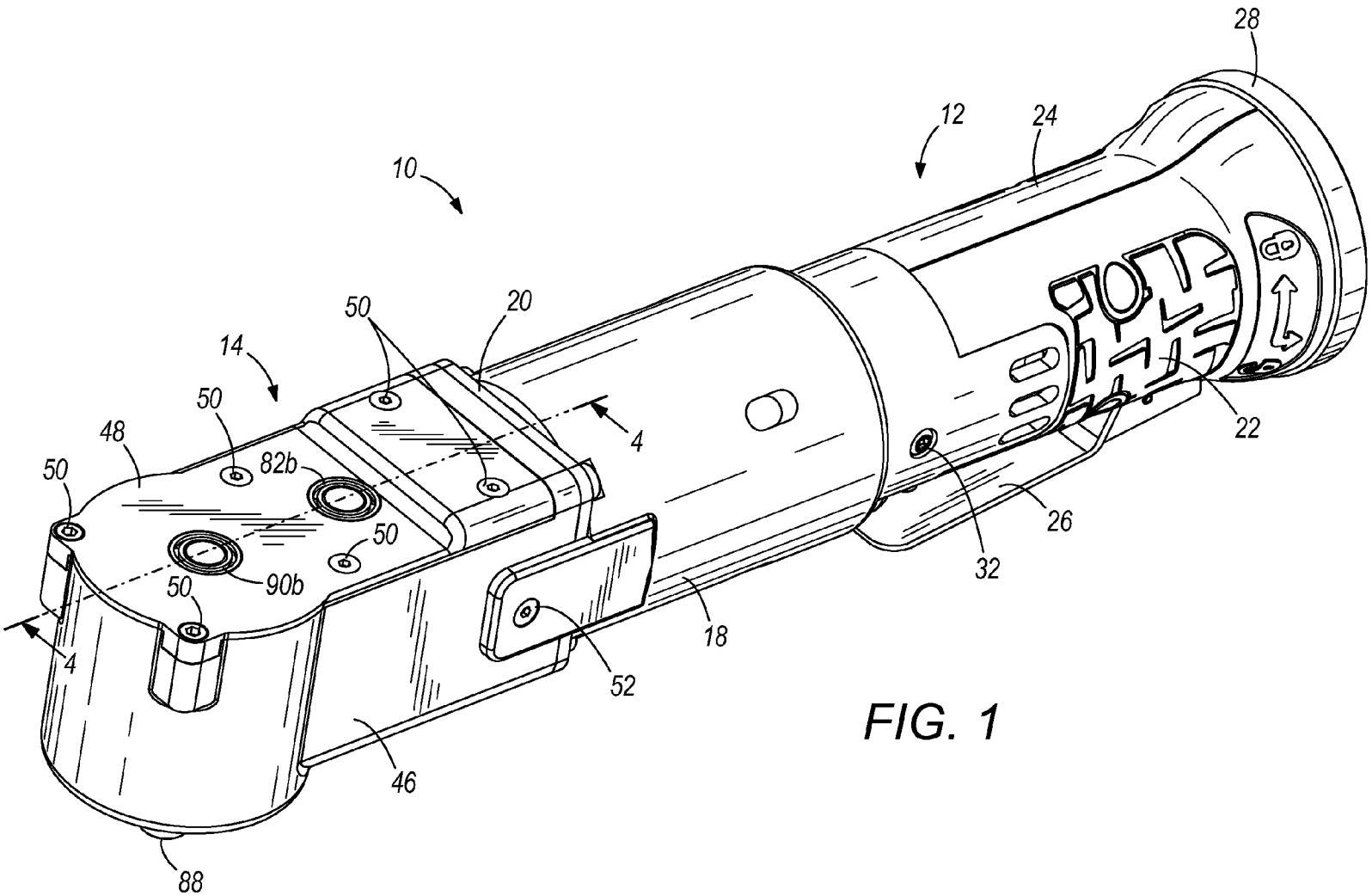
FIG. 1 is a perspective view of one illustrative embodiment of an angle impact tool.
Figure 2:
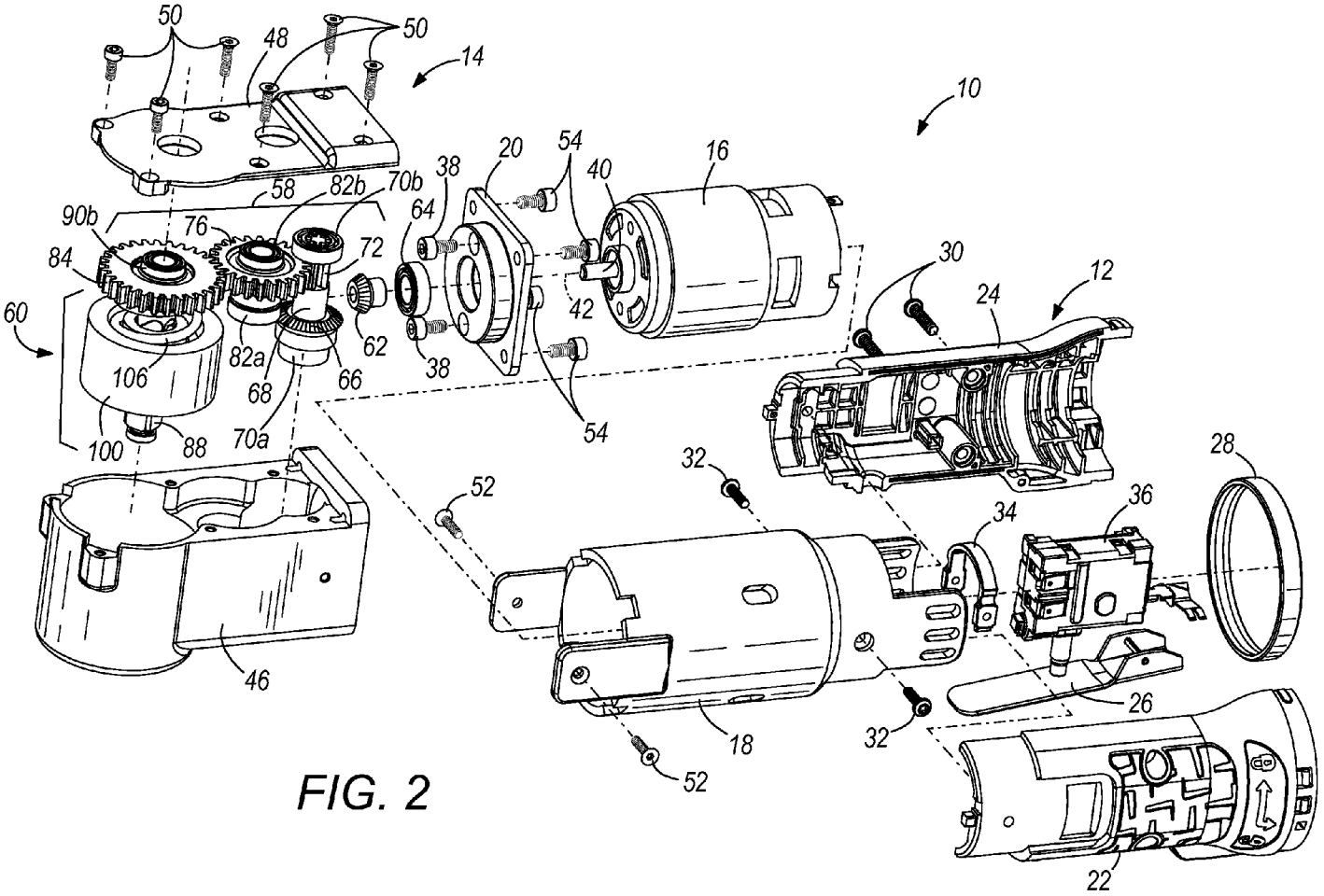
FIG. 2 is an exploded view of the angle impact tool of FIG. 1.
Figure 3:
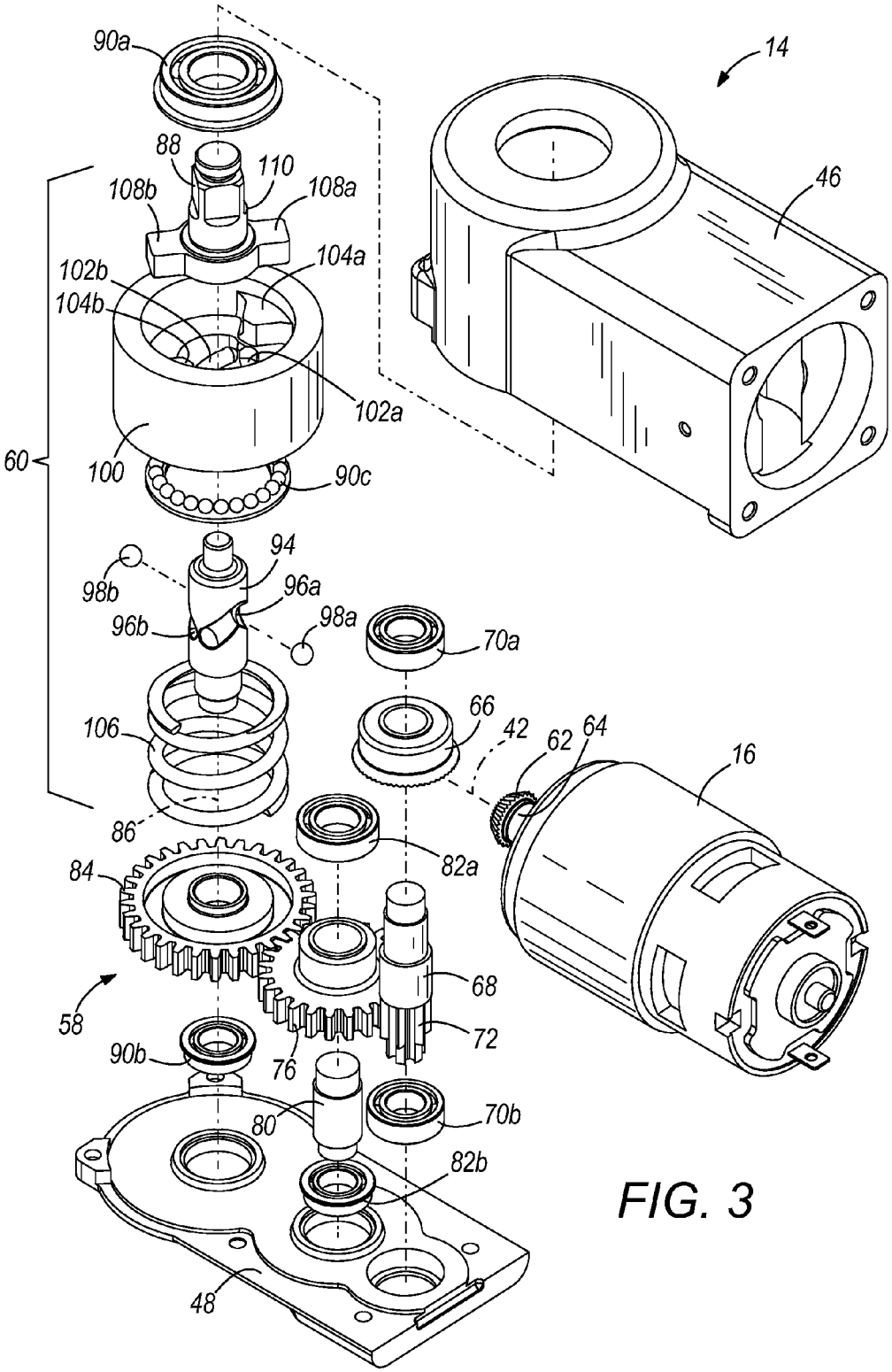
FIG. 3 is an exploded view of a work attachment of the angle impact tool of FIG. 1.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure. Unless otherwise specified, the terms "coupled," "mounted," "connected," "supported," and variations thereof are used broadly and encompass both direct and indirect couplings, mountings, connections, and supports.

Referring now to FIGS. 1-4, one illustrative embodiment of an angle impact tool 10 that includes a handle assembly 12 and a work attachment 14 is shown. The illustrated handle assembly 12 includes a motor 16, a motor housing 18, a motor bracket 20, a handle housing section 22, a handle housing section 24, a trigger lever 26, and a lock ring 28. The lock ring 28 and a plurality of fasteners 30 retain the two handle housing sections 22, 24 together. The motor housing 18 is coupled to the handle housing sections 22, 24 by a plurality of fasteners 32 and a U-shaped part 34. A switch 36 is included in the handle assembly 12 between the handle housing sections 22, 24. The switch 36 is coupled (mechanically and/or electrically) to the trigger lever 26, such that actuation of the trigger lever 26 causes actuation of the switch 36 and, therefore, operation of the motor 16.

The motor bracket 20 is coupled to the motor 16 by a plurality of fasteners 38. The motor 16 includes an output shaft, such as the illustrated rotor 40, that is rotatable about a longitudinal handle axis 42. The illustrated motor 16 is an electric motor, but any suitable prime mover (such as the pneumatic motor disclosed in U.S. Pat. No. 7,886,840, the entire disclosure of which is incorporated by reference herein) may be utilized. Although not shown in FIGS. 1-4, a battery and a directional reverse switch may be provided on the angle impact tool 10, in some embodiments.

The illustrated work attachment 14 includes a housing 46, 48 that is partitioned into two sections, namely, a housing body 46 and a housing cap 48. As described in greater detail below (with reference to the illustrative embodiment of FIGS. 8-12), the housing 46, 48 is partitioned along a parting plane that is perpendicular to an output axis 86 of the work attachment 14. A plurality of fasteners 50 removably couple the housing cap 48 to the housing body 46. The motor housing 18 is coupled to the housing body 46 with a plurality of fasteners 52. The motor bracket 20 is coupled to the housing body 46 by a plurality of fasteners 54.

Figure 4:
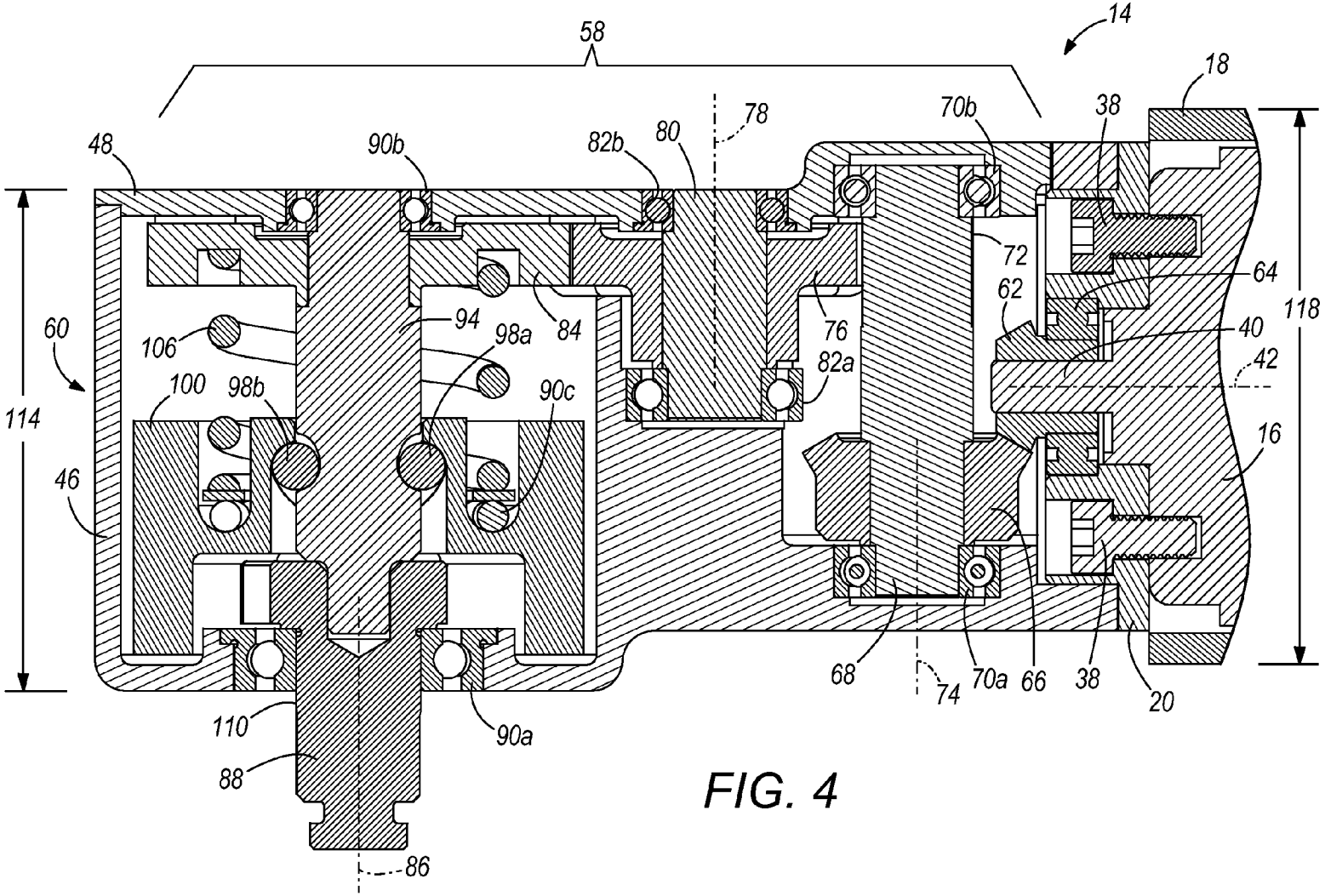
FIG. 4 is a cross-sectional view of the work attachment of FIG. 3, taken along line 4-4 in FIG. 1.
Figure 5A:
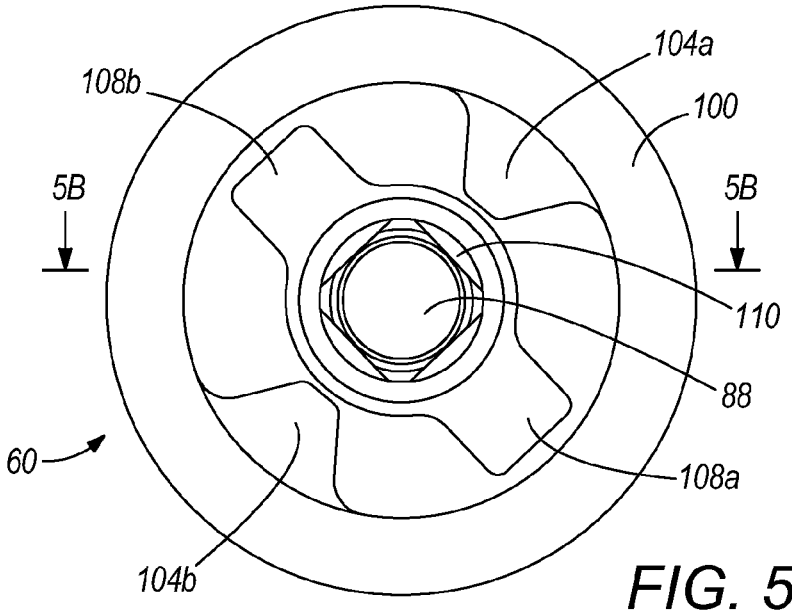
FIGS. 5A-5J illustrate an impact cycle of the angle impact tool of FIGS. 1-4.
Figure 5B:
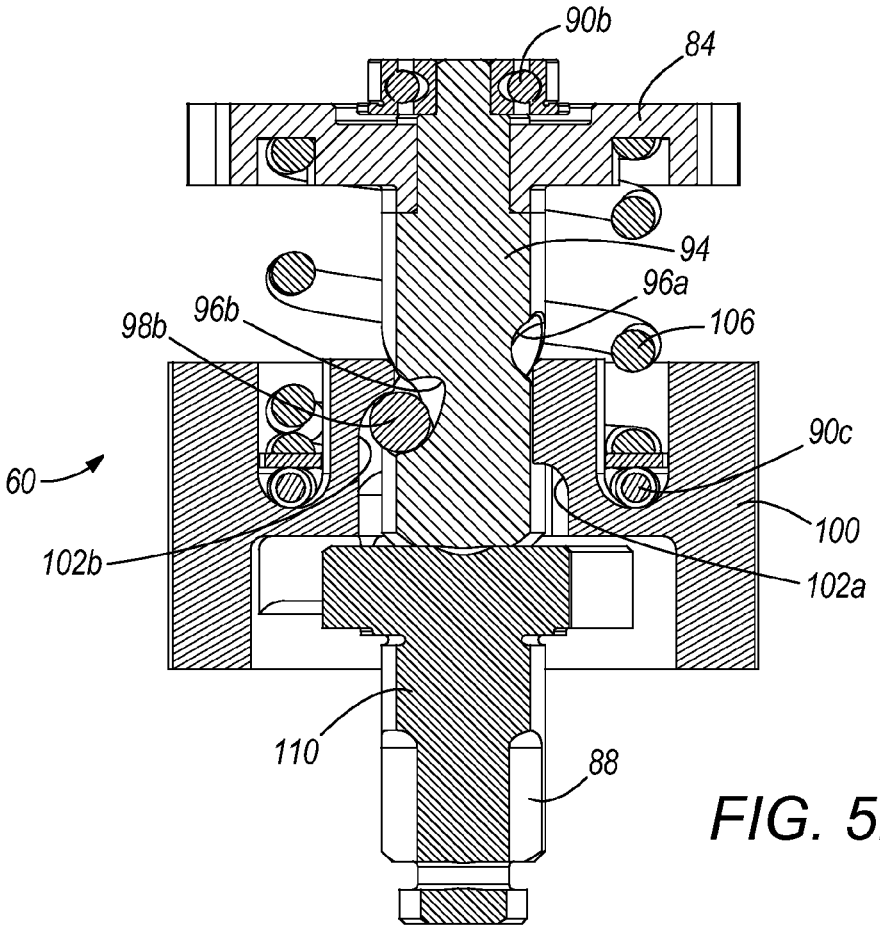
Figure 5C:
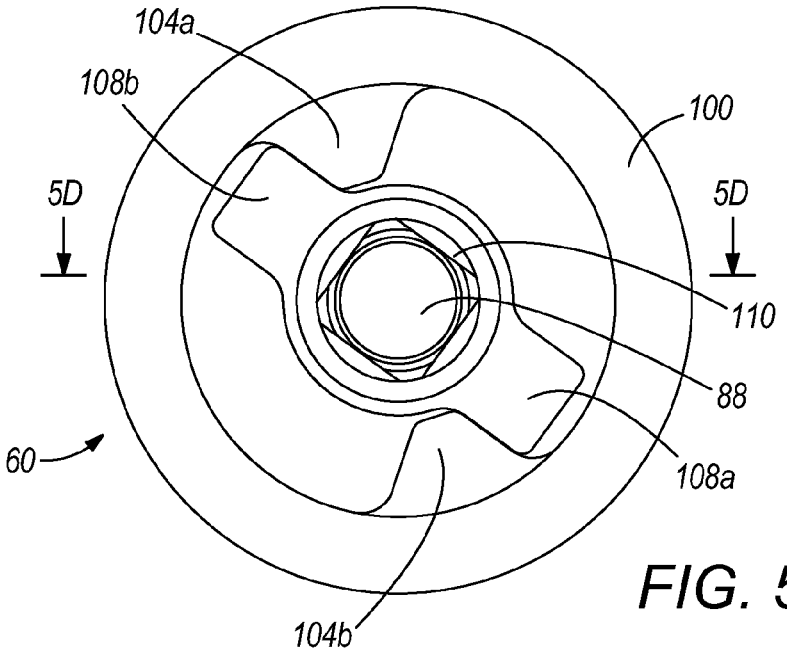
Figure 5D:
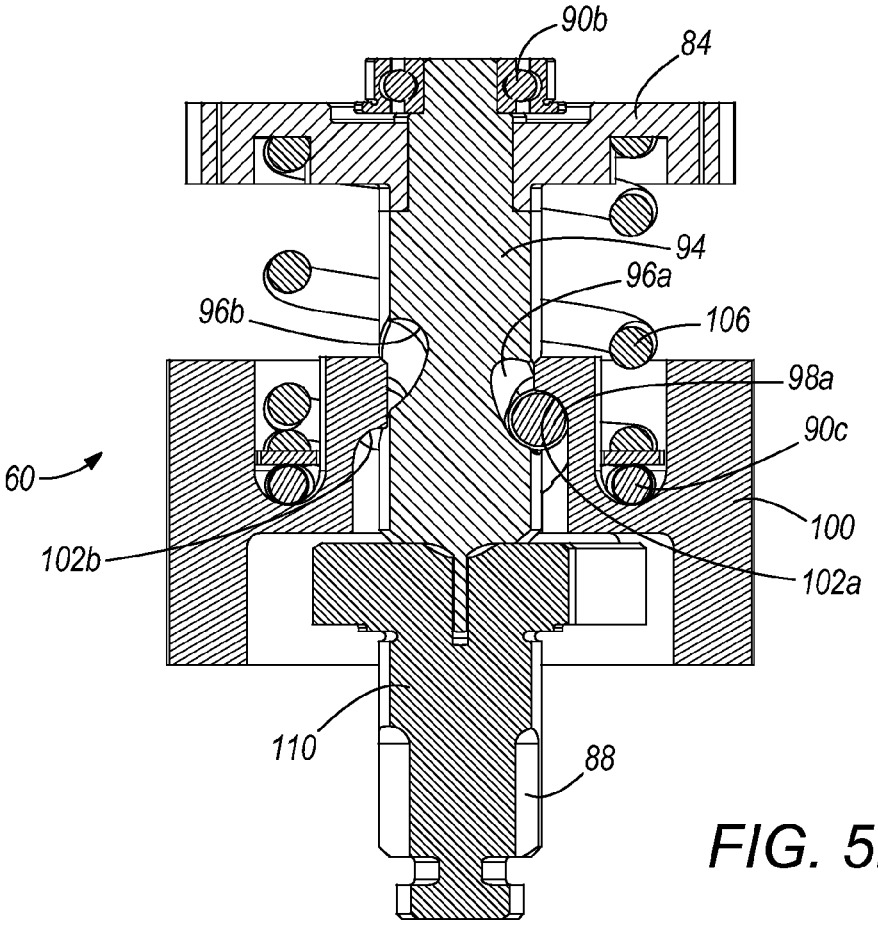
Figure 5E:
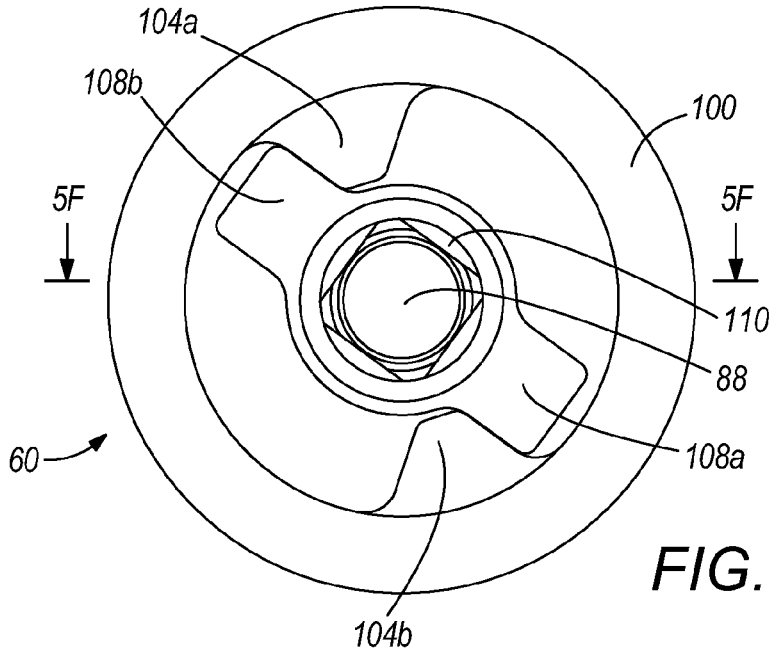
Figure 5F:
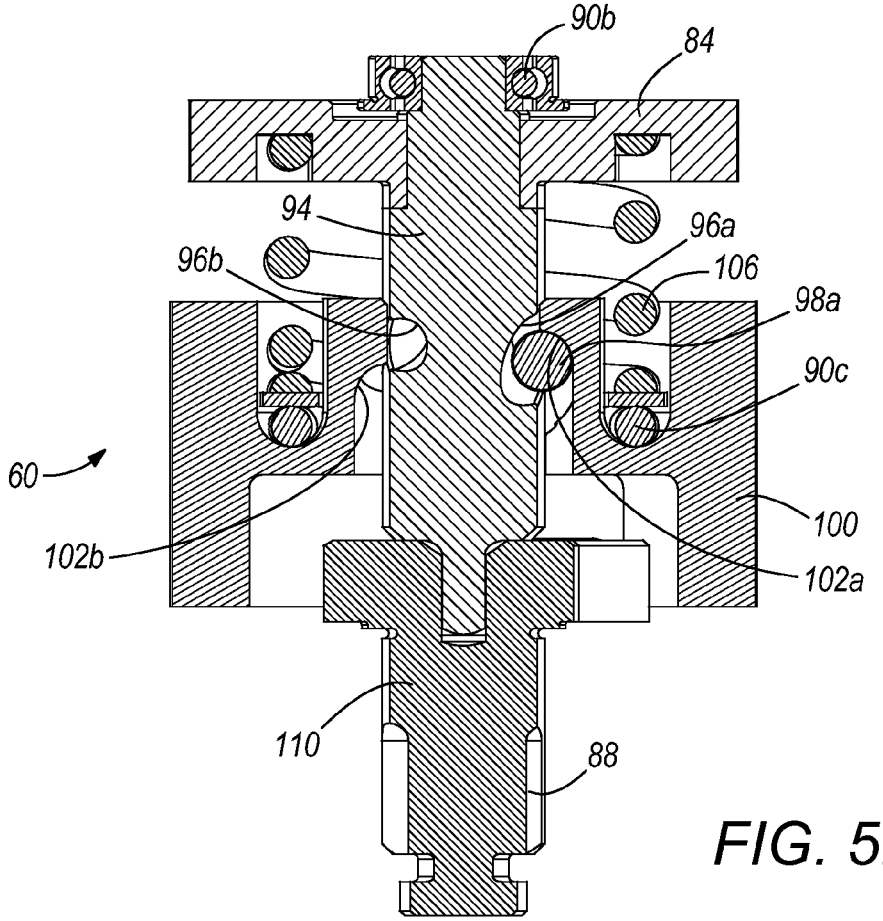
Figure 5G:
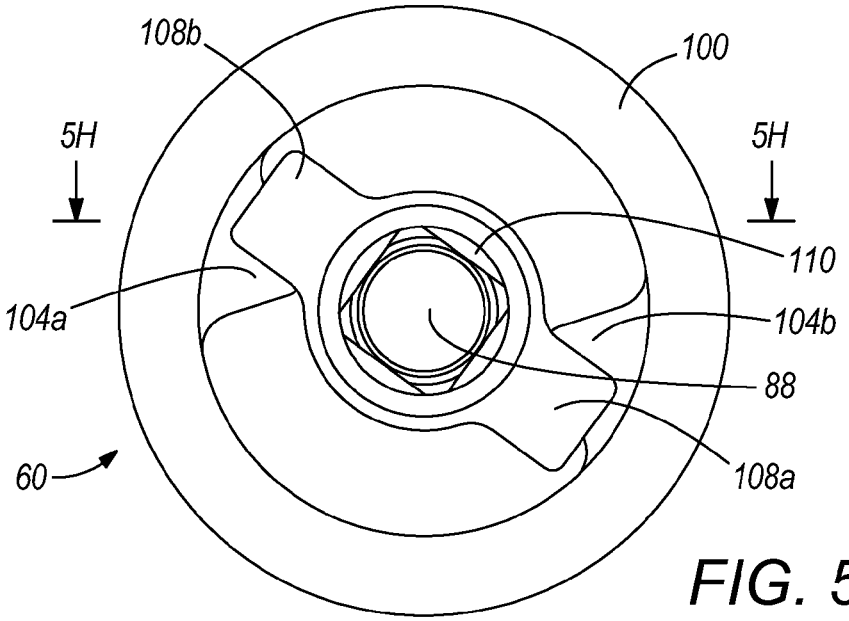
Figure 5H:
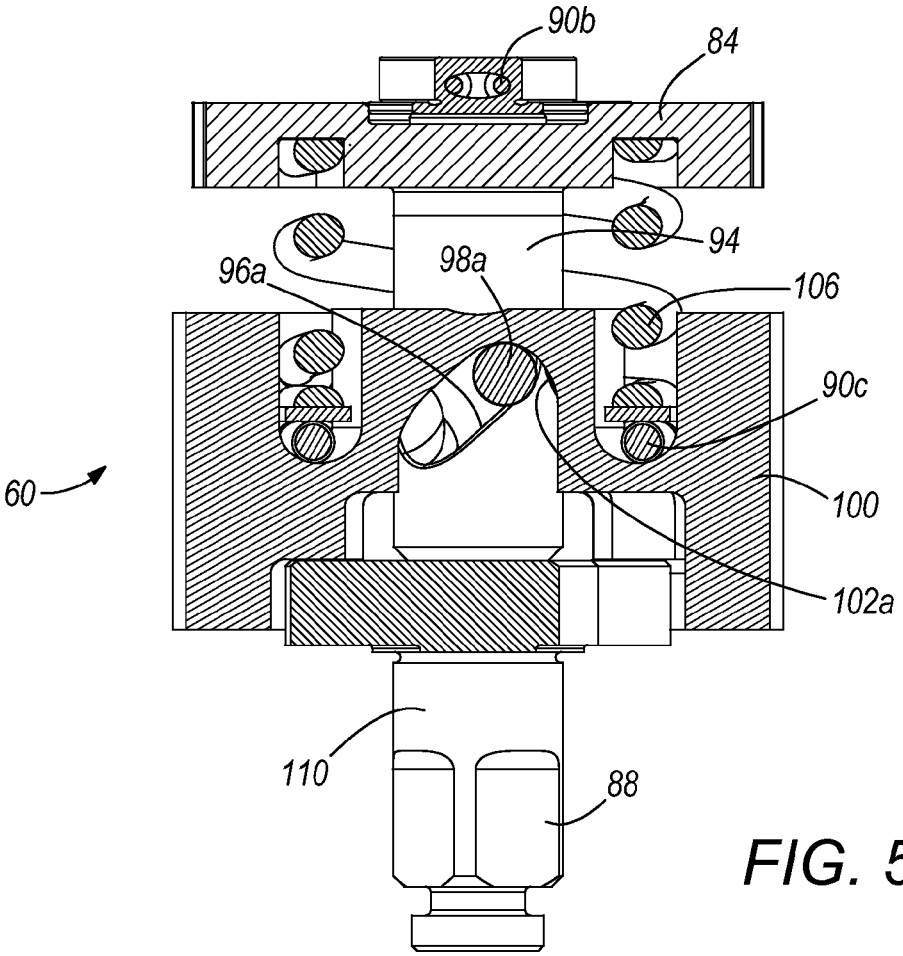
Figure 5I:
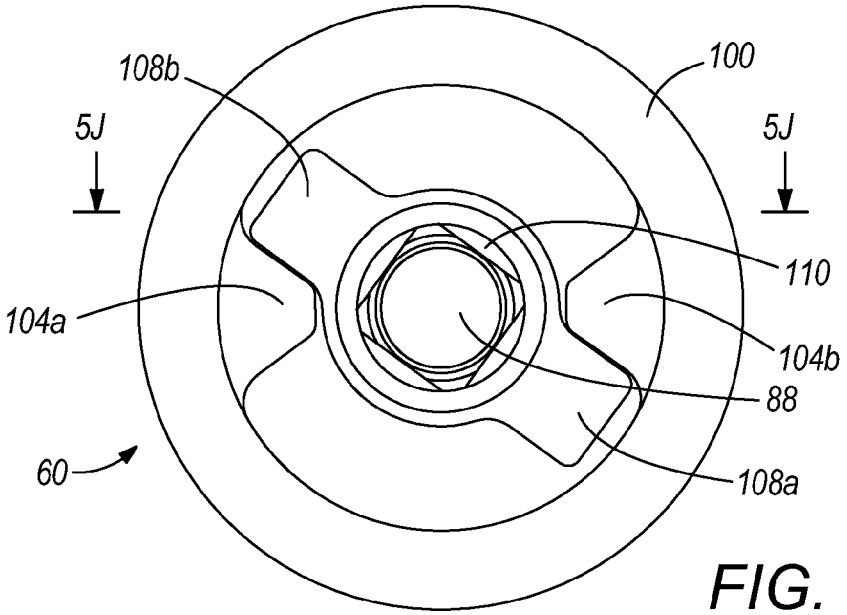
Figure 5J:
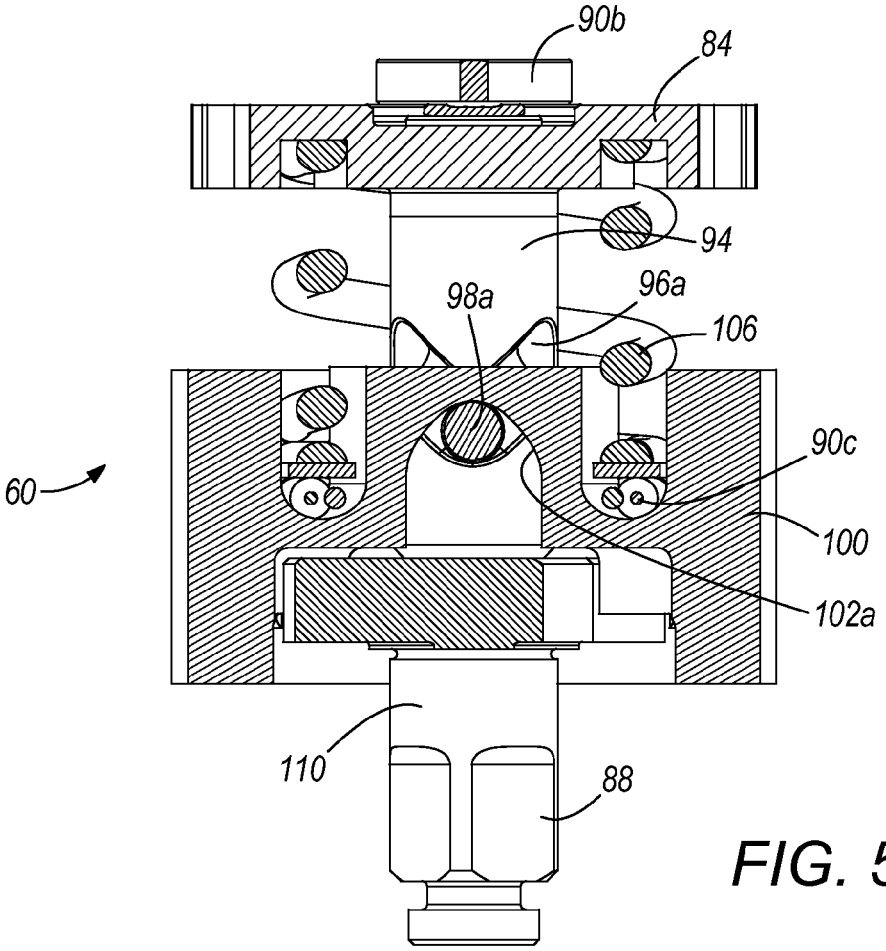

The housing 46, 48 of the illustrated work attachment 14 supports a gear assembly 58 and an impact mechanism 60. In the illustrative embodiment of FIGS. 1-4, the gear assembly 58 includes a bevel gear set comprising a bevel gear 62 and a bevel gear 66. The bevel gear 62 is coupled to the rotor 40 for rotation with the rotor 40 about the longitudinal handle axis 42. A bearing 64 is positioned between the bevel gear 62 and the motor bracket 20. The bevel gear 66 meshes with the bevel gear 62. The bevel gear 66 is coupled to a shaft 68 for rotation with the shaft 68 about an axis 74 (FIG. 4). The shaft 68 is supported in the housing 46, 48 of the work attachment 14 by bearings 70*a*, 70*b*. The shaft 68 includes a splined portion 72 near bearing 70*b*. The splined portion 72 functions as a spur gear and, in some embodiments, can be replaced with a spur gear.

In the illustrative embodiment of FIGS. 1-4, the gear assembly 58 also includes a spur gear set comprising the splined portion 72 of the shaft 68, an idler spur gear 76, and a drive spur gear 84. Rotation of the splined portion 72 of the shaft 68 causes rotation of the idler spur gear 76 about an axis 78 (FIG. 4). The idler spur gear 76 is coupled to a shaft 80 for rotation with the shaft 80 about the axis 78. The shaft 80 is supported in the housing 46, 48 of the work attachment 14 by bearings 82*a*, 82*b*.

The idler spur gear 76 meshes with a drive spur gear 84 to cause rotation of the drive spur gear 84 about the axis 86 (FIG. 4). The drive spur gear 84 is coupled to an output drive 88 through the impact mechanism 60 for selectively rotating the output drive 88. The drive spur gear 84 and the output drive 88 are supported for rotation within the housing 46, 48 by bearings 90*a*, 90*b*, 90*c*. The output drive 88 is illustratively embodied as a square drive that may be connected to a socket or other fastener-driving output element.

In the illustrative embodiment of FIGS. 1-4, the axes 74, 78, and 86 are all parallel to each other and are all perpendicular to the axis 42. It is contemplated that, in other embodiments, one or more of the axes 74, 78, and 86 may be oriented at another angle that is non-parallel to the axis 42.

The impact mechanism 60 may be embodied as any type of impact mechanism. In the illustrative embodiment of FIGS. 1-4, the impact mechanism 60 is a ball-and-cam-type impact mechanism. The impact mechanism 60 includes a cam shaft 94 coupled to the drive spur gear 84 for rotation with the drive spur gear 84 about the axis 86. The illustrated cam shaft 94 includes opposite cam grooves 96*a*, 96*b* that define pathways for respective balls 98*a*, 98*b*. The illustrated impact mechanism 60 further includes a hammer 100 that includes opposite cam grooves 102*a*, 102*b* that are substantially mirror-images of cam grooves 96*a*, 96*b*. The balls 98*a*, 98*b* are retained between the respective cam grooves 96*a*, 96*b*, 102*a*, 102*b*. The hammer 100 also includes hammer jaws 104*a*, 104*b*.

The motor 16 drives the gear assembly 58 and the impact mechanism 60 to drive rotation of the output drive 88, as shown in the illustrated embodiment. The output drive 88 is rotated about the axis 86, which is non-parallel to the axis 42. In the illustrative embodiment of FIGS. 1-4, the axis 86 is perpendicular to the axis 42. In other embodiments (not shown), the axis 86 may be at any acute or obtuse angle to the axis 42.

In the illustrative embodiment of FIGS. 1-4, a cylindrical spring 106 is positioned between the drive spur gear 84 and the hammer 100 to bias the hammer 100 away from the drive spur gear 84. The spring 106 surrounds a portion of the cam shaft 94. In the illustrated embodiment, the spring 106 rotates with the drive spur gear 84 and the bearing 90*c* permits the hammer 100 to rotate with respect to the spring 106. Other configurations are possible, and the illustrated configuration is given by way of example only.

The illustrated output drive 88 is integrally formed with anvil jaws 108*a*, 108*b* to create an anvil 110 of the impact mechanism 60. In other embodiments, the output drive 88 may be coupled to the anvil 110 (such that rotation of the anvil 110 drives rotation of the output drive 88). The anvil 110 is supported for rotation within the housing body 46 by the bearing 90*a*. The hammer jaws 104*a*, 104*b* impact the anvil jaws 108*a*, 108*b* to drive the output drive 88 in response to rotation of the drive spur gear 84. In particular, the hammer jaws 104*a*, 104*b* rotate to periodically deliver an impact load to the anvil jaws 108*a*, 108*b* and, thereby, cause intermittent rotation of the output drive 88.

In the illustrative embodiment of FIGS. 1-4, the impact cycle of the impact mechanism 60 is illustrated in FIGS. 5A-5J. The spring 106 permits the hammer 100 to rebound after impact, and balls 98*a*, 98*b* guide the hammer 100 to ride up around the cam shaft 94, such that hammer jaws 104*a*, 104*b* are spaced axially from the anvil jaws 108*a*, 108*b*. The hammer jaws 104*a*, 104*b* are permitted to rotate past the anvil jaws 108*a*, 108*b* after the rebound. In other words, as the hammer 100 rotates about the axis 86, the hammer 100 also reciprocally translates along the axis 86 (due to the balls 98*a*, 98*b* and the spring 106). FIGS. 5A-5J illustrate one impact cycle of the impact mechanism 60 of FIGS. 1-4. It will be appreciated that the impact cycle illustrated in FIGS. 5A-5J is exemplary in nature and that, in other embodiments, impact mechanisms with different impact cycles may be used.

Figure 6:
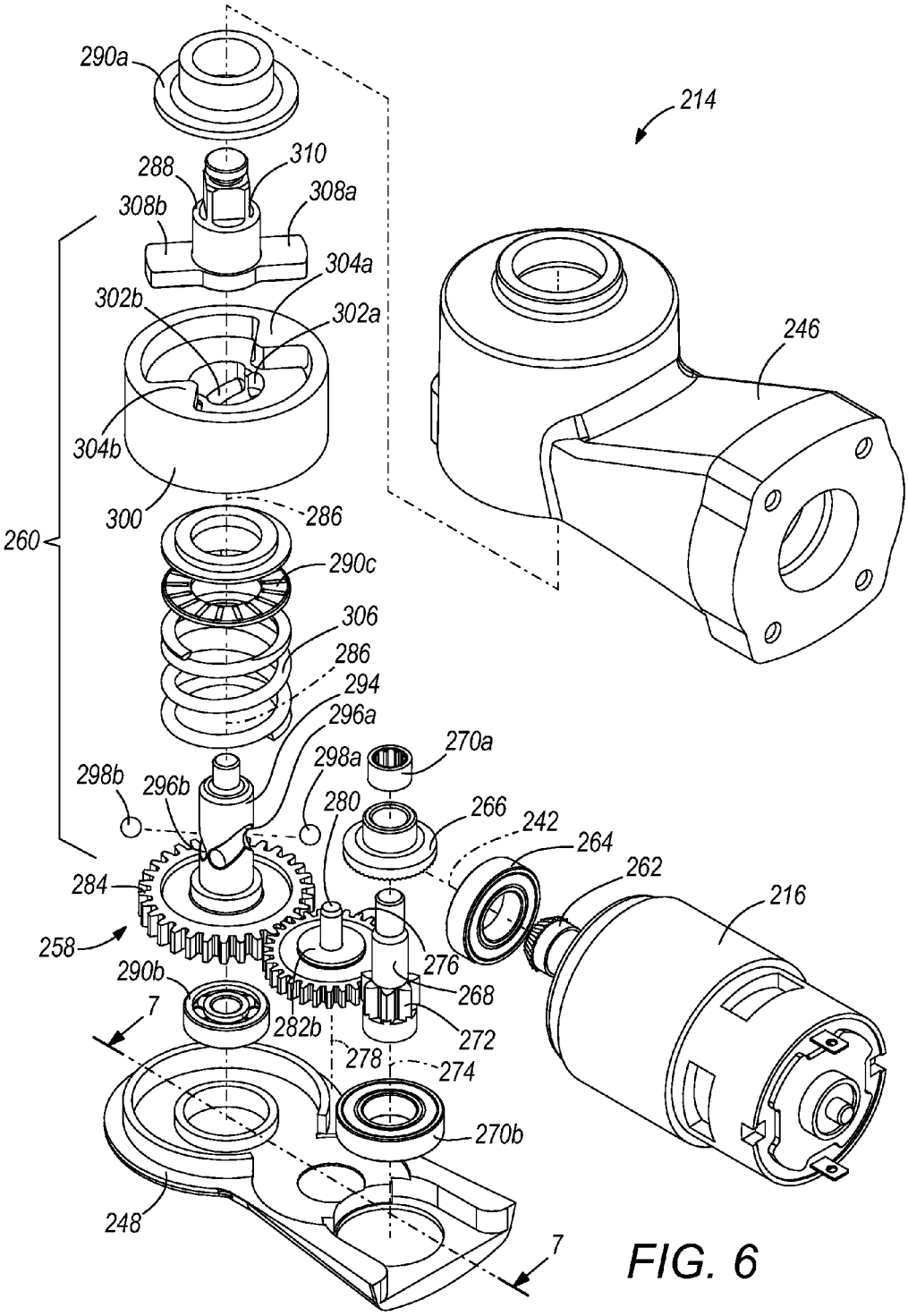
FIG. 6 is an exploded view of another illustrative embodiment of a work attachment for an angle impact tool.
Figure 7:
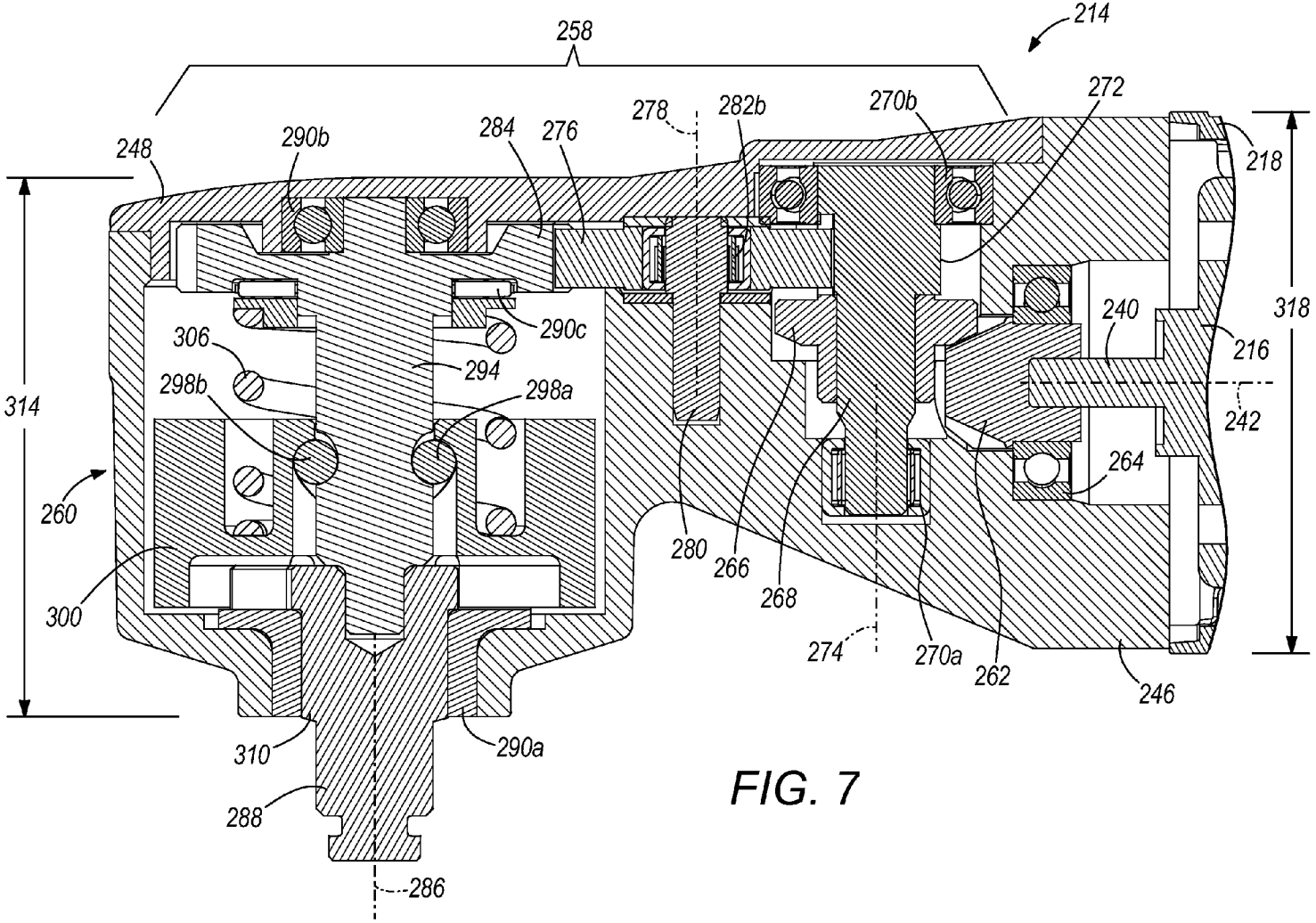
FIG. 7 is a cross-sectional view of the work attachment of FIG. 6, taken along line 7-7 in FIG. 6.

FIGS. 6 and 7 illustrate another embodiment of a work attachment 214 for use with an angle impact tool. The work attachment 214 may be coupled to a handle and a motor 216 having a rotor 240 (i.e., an output shaft). The motor 216 is supported by a motor housing 218. The illustrated motor 216 is an electric motor, but any suitable prime mover (such as the pneumatic motor disclosed in U.S. Pat. No. 7,886,840) may be utilized. Although not specifically illustrated, a battery and a directional reverse switch may be provided on the angle impact tool, in some embodiments.

The work attachment 214 includes a housing 246, 248 that is partitioned into two sections, namely, a housing body 246 and a housing cap 248. As described in greater detail below (with reference to the illustrative embodiment of FIGS. 8-12), the housing 246, 248 is partitioned along a parting plane that is perpendicular to an output axis 286 of the work attachment 214. The housing body 246 and the housing cap 248 cooperate to support a gear assembly 258 and an impact mechanism 260.

The rotor 240 of the motor 216 rotates about a longitudinal handle axis 242. In the illustrative embodiment of FIGS. 6 and 7, the gear assembly 258 includes a bevel gear set comprising a bevel gear 262 and a bevel gear 266. The bevel gear 262 is coupled to the rotor 240 for rotation with the rotor 240 about the longitudinal handle axis 242. A bearing 264 is positioned between the bevel gear 262 and the motor housing 218. The bevel gear 266 meshes with the bevel gear 262. The bevel gear 266 is coupled to a shaft 268 for rotation with the shaft 268. The shaft 268 is supported in the housing 246, 248 of the work attachment 214 by bearings 270*a*, 270*b*. The shaft 268 includes a splined portion 272 near bearing 270*b*. The shaft 268 rotates about an axis 274. The splined portion 272 functions as a spur gear and, in some embodiments, can be replaced with a spur gear.

In the illustrative embodiment of FIGS. 6 and 7, the gear assembly 258 also includes a spur gear set comprising the splined portion 272 of shaft 268, an idler spur gear 276, and a drive spur gear 284. Rotation of the splined portion 272 of shaft 268 causes rotation of the idler spur gear 276 about an axis 278. The idler spur gear 276 is coupled to a shaft 280 for rotation with the shaft 280 about the axis 278. The shaft 280 is supported in the housing 246, 248 of the work attachment 214 by bearings 282*a*, 282*b*.

The idler spur gear 276 meshes with the drive spur gear 284 to cause rotation of the drive spur gear 284 about an axis 286. The drive spur gear 284 is coupled to an output drive 288 through the impact mechanism 260 for selectively rotating the output drive 288. The drive spur gear 284 and the output drive 288 are supported for rotation within the housing 246, 248 of the work attachment 214 by bushing 290*a* and bearings 290*b*, 290*c*. The output drive 288 is illustratively embodied as a square drive that may be connected to a socket or other fastener-driving output element.

In the illustrative embodiment of FIGS. 6 and 7, the axes 274, 278, and 286 are all parallel to each other and are all perpendicular to axis 242. It is contemplated that, in other embodiments, one or more of the axes 274, 278, and 286 may be oriented at another angle that is non-parallel to axis 242.

The impact mechanism 260 may be embodied as any type of impact mechanism. In the illustrative embodiment of FIGS. 6 and 7, the impact mechanism 260 is a ball-and-cam-type impact mechanism. The impact mechanism 260 includes a cam shaft 294 coupled to the drive spur gear 284 for rotation with the drive spur gear 284 about the axis 286. The illustrated cam shaft 294 includes opposite cam grooves 296*a*, 296*b* that define pathways for respective balls 298*a*, 298*b*. The illustrated impact mechanism 260 further includes a hammer 300 that includes opposite cam grooves 302*a*, 302*b* that are substantially mirror-images of cam grooves 296*a*, 296*b*. The balls 298*a*, 298*b* are retained between the respective cam grooves 296*a*, 296*b*, 302*a*, 302*b*. The hammer 300 also includes hammer jaws 304*a*, 304*b*.

The motor 216 drives the gear assembly 258 and the impact mechanism 260 to drive rotation of the output drive 288, as shown in the illustrated embodiment. The output drive 288 is rotated about the axis 286, which is non-parallel to the axis 242. In the illustrative embodiment of FIGS. 6 and 7, the axis 286 is perpendicular to the axis 242. In other embodiments (not shown), the axis 286 may be at any acute or obtuse angle to the axis 242.

In the illustrative embodiment of FIGS. 6 and 7, a cylindrical spring 306 is positioned between the drive spur gear 284 and the hammer 300 to bias the hammer 300 away from the drive spur gear 284. The spring 306 surrounds a portion of the cam shaft 294. In the illustrated embodiment, the spring 306 rotates with the drive spur gear 284, and the bearing 290*c* permits the hammer 300 to rotate with respect to the spring 306. Other configurations are possible, and the illustrated configuration is given by way of example only.

The illustrated output drive 288 is integrally formed with anvil jaws 308*a*, 308*b* to create an anvil 310 of the impact mechanism 260. In other embodiments, the output drive 288 may be coupled to the anvil 310 (such that rotation of the anvil 310 drives rotation of the output drive 288). The anvil 310 is supported for rotation within the housing body 246 by the bushing 290*a*. The hammer jaws 304*a*, 304*b* impact the anvil jaws 308*a*, 308*b* to drive the output drive 288 in response to rotation of the drive spur gear 284. In particular, the hammer jaws 304*a*, 304*b* rotate to periodically deliver an impact load to the anvil jaws 308*a*, 308*b* and, thereby, cause intermittent rotation of the output drive 288. The impact cycle of the impact mechanism 260 is similar to the impact cycle illustrated in FIGS. 5A-5J. It will be appreciated that the impact cycle illustrated in FIGS. 5A-5J is exemplary in nature and that, in other embodiments, impact mechanisms with different impact cycles may be used.

Figure 8:
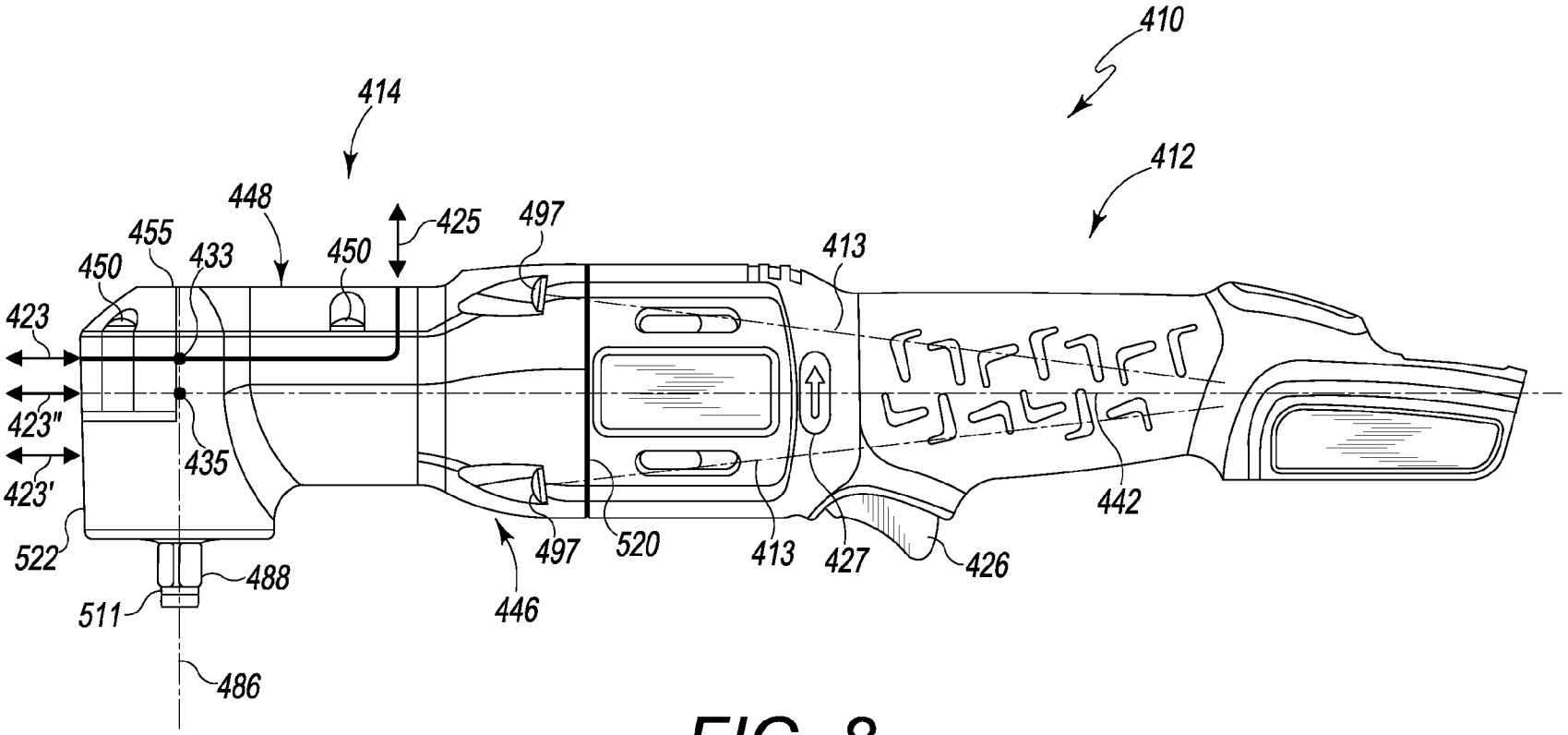
FIG. 8 is a side elevation view of yet another illustrative embodiment of an angle impact tool including a work attachment.

FIG. 8 illustrates yet another illustrative embodiment of an angle impact tool 410. The angle impact tool 410 includes a handle assembly 412 and a work attachment 414 coupled to the handle assembly 412. As described in more detail below, the handle assembly 412 supports a motor 416, and the work attachment 414 supports a gear assembly 458, an impact mechanism 460, and an output drive 488. While the tool 410 is in use, torque generated by the motor 416 is transferred via the gear assembly 458 to the impact mechanism 460, which in turn delivers torque (via a series of powerful rotary blows) to the output drive 488.

Figure 9:
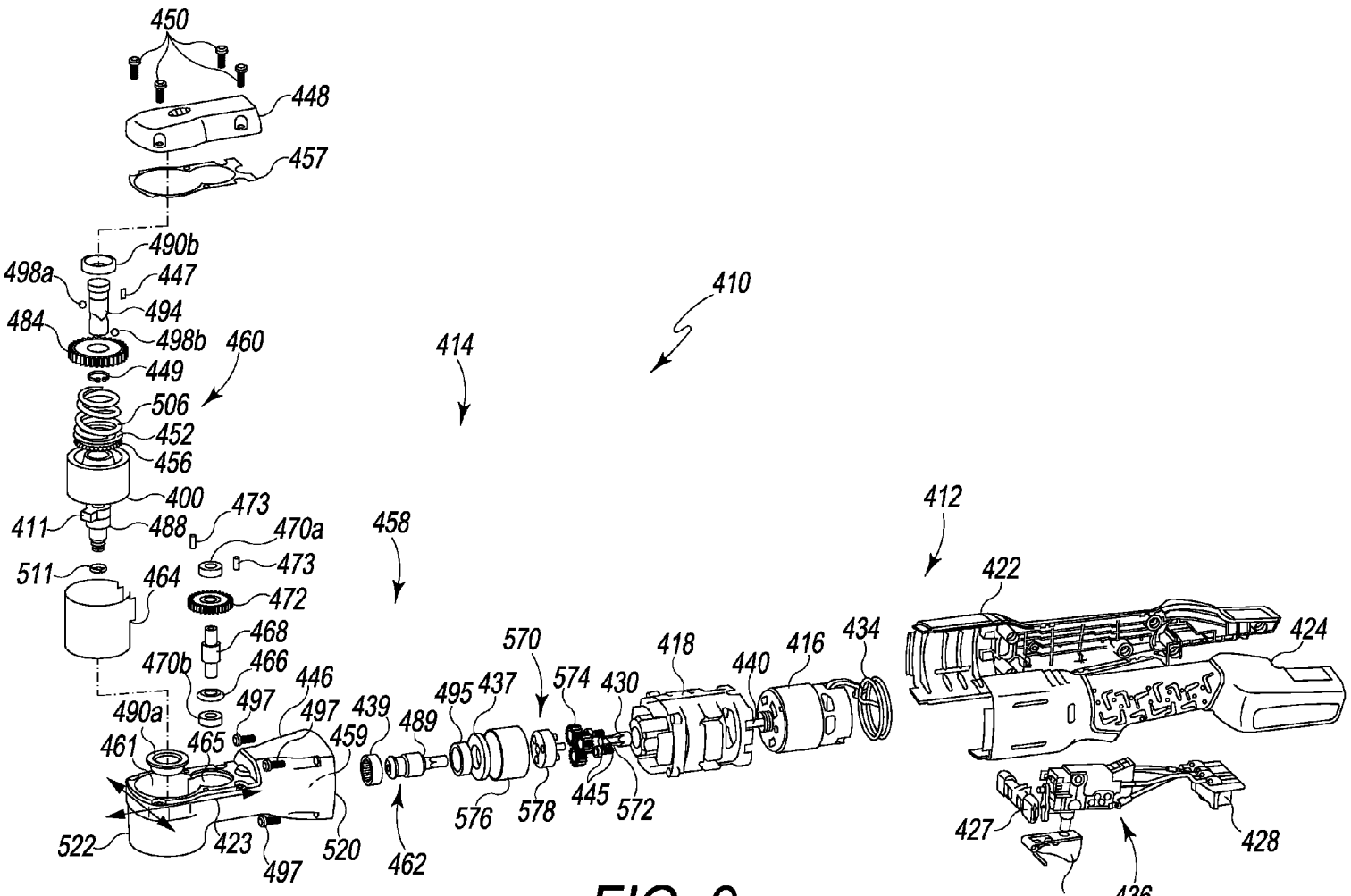
FIG. 9 is an exploded view of the angle impact tool of FIG. 8.
Figure 10:
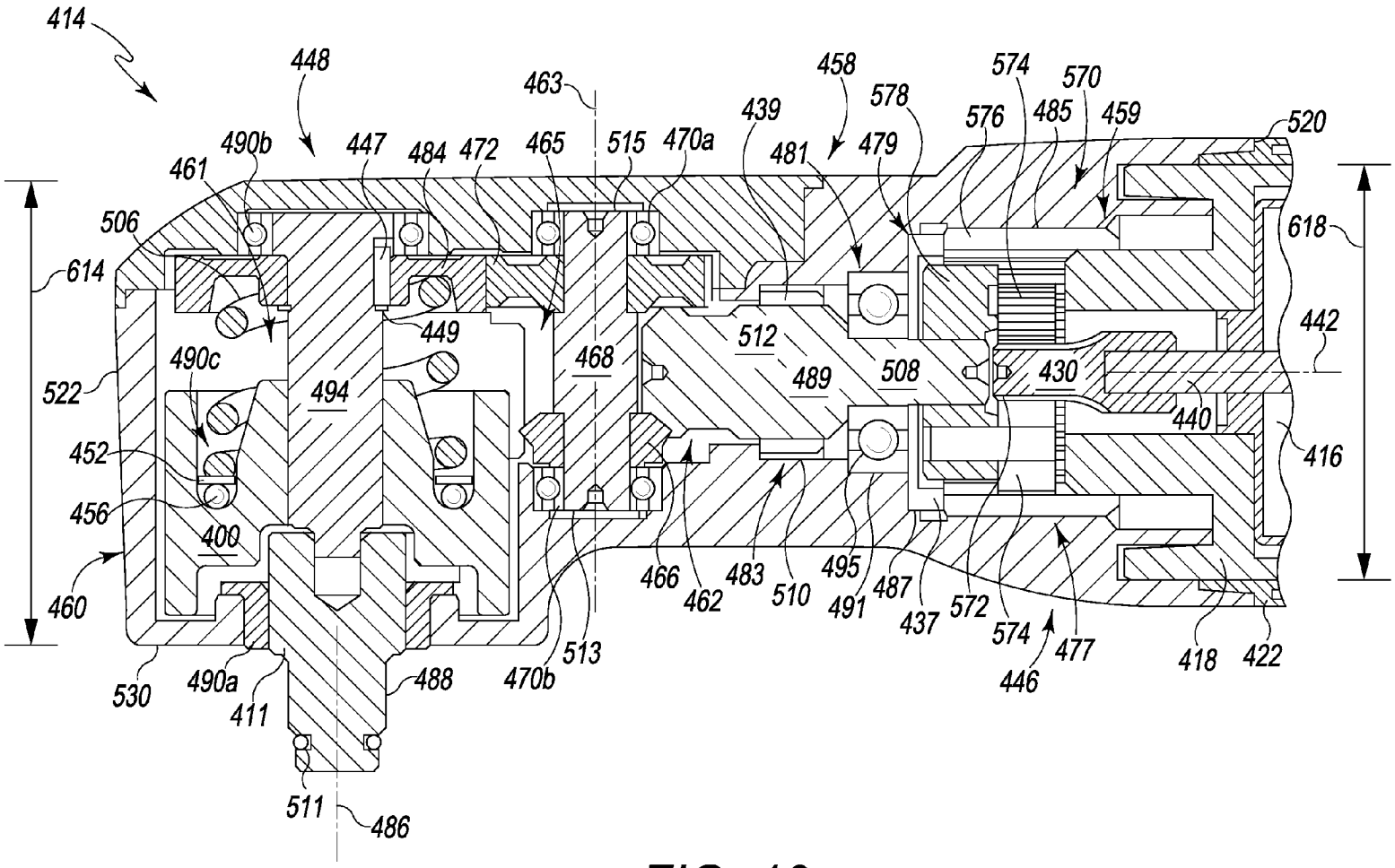
FIG. 10 is a cross-sectional view of the work attachment of the angle impact tool of FIG. 8, taken along a similar line to the cross-sectional views of FIGS. 4 and 7.

The handle assembly 412 extends along a longitudinal handle axis 442, as shown in FIG. 8. The handle assembly 412 illustratively includes a handle housing section 422 and a handle housing section 424, as best seen in FIG. 9. A plurality of fasteners (not shown) are used to secure the two handle housing sections 422, 424 together. As shown in FIGS. 9 and 10, the handle assembly 412 supports the motor 416 such that an output shaft 440 of the motor 416 (e.g., the illustrated rotor 440) is rotatable about the axis 442. The illustrated motor 416 is an electric motor, but any suitable prime mover (such as the pneumatic motor disclosed in U.S. Pat. No. 7,886,840) may be utilized.

As shown in FIGS. 8 and 10, the work attachment 414 supports the output drive 488 for rotation about an output axis 486. Torque generated by the motor 416 is transferred via the gear assembly 458 to the impact mechanism 460 to cause the output drive 488 to rotate about the axis 486. In the illustrative embodiment of FIGS. 8-12, the axis 486 is perpendicular to the axis 442 such that the tool 410 is a right-angle impact tool. In other embodiments (not shown), the axis 486 may be at any acute or obtuse angle to the axis 442.

The work attachment 414 includes a housing 446, 448 that is partitioned into two (or more) sections. In other words, the housing 446, 448 of the work attachment 414 includes a housing section 446 and a housing section 448 that are physically separable from one another. In the illustrative embodiment of FIGS. 8-12, the housing 446, 448 is partitioned along a parting plane 423 into a housing body 446 and a housing cap 448. The parting plane 423 is defined by the line 423 shown in FIG. 8 and by a line traveling directly into and out of the page of FIG. 8. In this illustrative embodiment, the parting plane 423 that primarily separates the housing body 446 and the housing cap 448 is perpendicular (i.e., orthogonal) to the output axis 486 of the work attachment 414. Furthermore, in this illustrative embodiment, the parting plane 423 is parallel to the axis 442 and is spaced apart from the axis 442 away from the output drive 488. In other words, as illustrated in FIG. 8, the axis 442 intersects the axis 486 between the position of the output drive 488 along the axis 486 and a point 433 at which the axis 486 intersects the parting plane 423.

As shown in the illustrative embodiment of FIG. 8, the housing body 446 and the housing cap 448 are also partitioned along a parting plane 425 that is perpendicular (i.e., orthogonal) to the axis 442. The parting plane 425 is defined by the line 425 shown in FIG. 8 and by a line traveling directly into and out of the page of FIG. 8. In this illustrative embodiment, the parting plane 425 is parallel to the axis 486 and is spaced apart from the axis 486 toward a rear end 520 of the work attachment 414 that is coupled to the handle assembly 412. As such, when the housing cap 448 is coupled to the housing body 446, the housing cap 448 abuts the housing body 446 along a portion of the parting plane 423 that extends from a front end 522 of the work attachment 414 (opposite the rear end 520 of the work attachment 414) to the parting plane 425. Similarly, when the housing cap 448 is coupled to the housing body 446, the housing cap 448 abuts the housing body 446 along a portion of the parting plane 425 that extends from an exterior profile 455 of the housing cap 448 to the parting plane 423.

Although the housing 446, 448 of the work attachment 414 is illustrated in FIGS. 8-12 (and will be generally described herein) as being partitioned along the parting planes 423, 425, it is contemplated that the housing 446, 448 may alternatively be partitioned along different parting planes in other embodiments. For instance, in one illustrative embodiment, the housing 446, 448 may be partitioned into two housing sections along a parting plane 423'. This parting plane 423' is defined by the line 423' shown in FIG. 8 and by a line traveling directly into and out of the page of FIG. 8. Like the parting plane 423, the parting plane 423' that primarily separates the housing sections 446, 448 in this embodiment is perpendicular to the output axis 486 of the work attachment 414 and parallel to the axis 442. In contrast to the parting plane 423, however, the parting plane 423' is spaced apart from the axis 442 toward (rather than away) from the output drive 488. In other words, as illustrated in FIG. 8, the parting plane 423' intersects the axis 486 between the position of the output drive 488 along the axis 486 and a point 435 at which the axis 486 intersects the axis 442. In this illustrative embodiment, the two housing sections 446, 448 may also be partitioned by the parting plane 425.

In another illustrative embodiment, the housing 446, 448 may be partitioned into two housing sections along a parting plane 423". This parting plane 423" is defined by the line 423" shown in FIG. 8 and by a line traveling directly into and out of the page of FIG. 8. Like the parting plane 423 (and the parting plane 423'), the parting plane 423" that primarily separates the housing sections 446, 448 in this embodiment is perpendicular to the output axis 486 of the work attachment 414 and parallel to the axis 442. In contrast to the parting plane 423 (and the parting plane 423'), however, the axis 442 lies in the parting plane 423" (rather than the parting plane 423" being spaced apart from the axis 442). In some embodiments, the two housing sections 446, 448 may also be partitioned along the entire parting plane 423" from the front end 522 to the rear end 520 of the work attachment 414.

Just as the housing 446, 448 may be partitioned by any number of parting planes that are perpendicular to the axis 486 (i.e., other parting planes that are parallel to the illustrated parting planes 423, 423', 423"), the housing 446, 448 may also be partitioned by any number of parting planes that are perpendicular to the axis 442 (i.e., other parting planes that are parallel to the illustrated parting plane 425). As noted above, it is also contemplated that the housing 446, 448 may be partitioned solely along a parting plane that is perpendicular to the axis 486, without being partitioned along a secondary parting plane that is perpendicular to the axis 442. It will also be appreciated that, in embodiments where multiple parting planes are used to partition the housing 446, 448, the multiple parting planes need not be perpendicular to one another.

Figure 11:
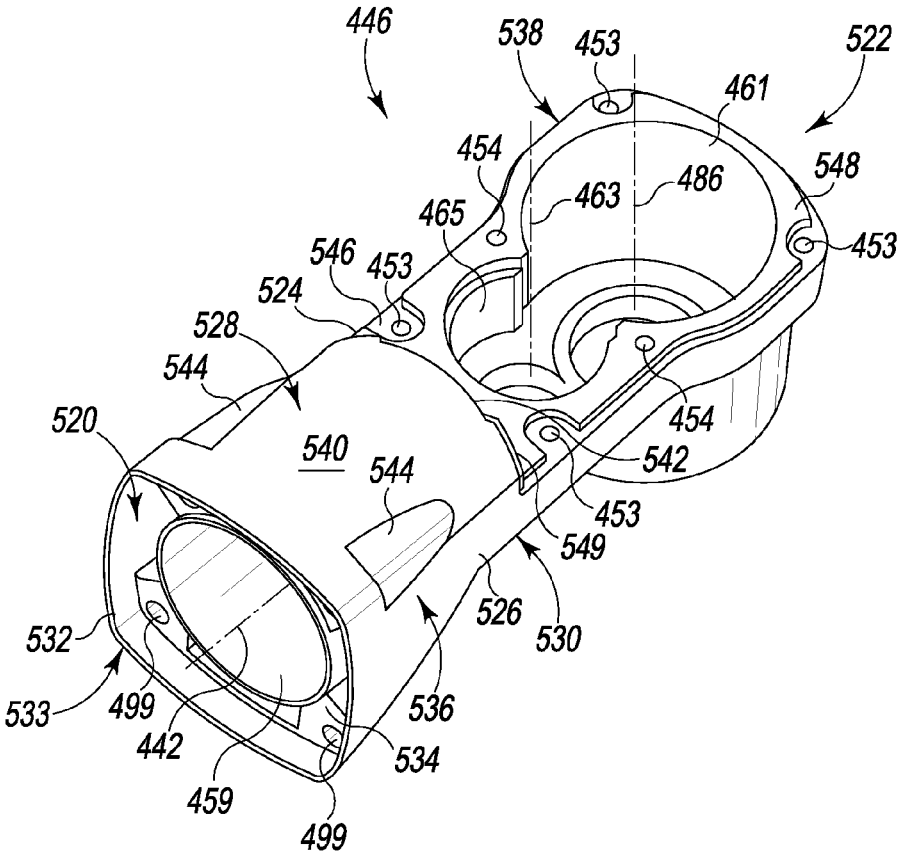
FIG. 11 is a perspective view of a housing body of the work attachment of the angle impact tool of FIG. 8.

As shown in FIGS. 8 and 9, the housing cap 448 is removably coupled to the housing body 446 using a plurality of fasteners 450. When the housing cap 448 is removably coupled to the housing body 446, each of the fasteners 450 extends through one of a plurality of apertures 451 formed in the housing cap 448 (FIG. 12) and is received in one of a plurality of bores 453 formed in the housing body 446 (FIG. 11). In the illustrative embodiment, the fasteners 450 are embodied as threaded fasteners (e.g., screws), while the bores 453 are formed to include internal threading that engages the threaded fasteners 450. As shown in FIG. 8, the apertures 451 formed in the housing cap 448 may be recessed from the exterior profile 455 of the housing cap 448. As such, when the housing cap 448 is removably coupled to the housing body 446, each of the fasteners 450 is received in one of the apertures 451 such that the fasteners 450 do not extend beyond the exterior profile 455 of the housing cap 448.

In the illustrative embodiment, the housing body 446 of the work attachment 414 is removably coupled to the handle assembly 412 using a plurality of fasteners 497, as shown in FIG. 8. Each of the plurality of fasteners 497 extends through one of a plurality of apertures 499 formed in the housing body 446 (FIG. 11) and is received in one of a plurality of bores (not shown) formed in the handle assembly 412. In the illustrative embodiment, the fasteners 497 are embodied as threaded fasteners (e.g., screws), while the bores formed in the handle assembly 412 include internal threading to engage the threaded fasteners 497. As suggested in FIG. 8, each of the bores formed in the handle assembly 412 extends along an axis 413. In the illustrative embodiment, each of the axes 413 is disposed at an acute angle to the axis 442, such that the axes 413 are non-parallel to the axis 442 and to one another. This configuration may increase the serviceability of the angle impact tool 410 by allowing the fasteners 497 to be more readily installed and removed from the bores formed in the handle assembly 412. For instance, in one illustrative embodiment, each of the axes 413 intersects the axis 442 at an 11 degree angle.

FIG. 9 illustrates an exploded view of the angle impact tool 410, including the components of both the handle assembly 412 and the work attachment 414. As discussed above, the handle assembly 412 includes the handle housing sections 422, 424 that are coupled together using a plurality of fasteners (not shown). The handle assembly 412 includes a switch 436 that is coupled to a trigger 426 such that actuation of the trigger 426 causes actuation of the switch 436 and, therefore, operation of the motor 416 of the tool 410. The handle assembly 412 also includes a directional control 427 that is coupled to the switch 436 to control the rotational direction of the output shaft 440 of the motor 416 (i.e., counterclockwise or clockwise about the axis 442). The trigger 426 and the directional control 427 are each supported by the handle housing sections 422, 424 such that the trigger 426 and the directional control 427 are both accessible from the exterior of the handle assembly 412, as shown in FIG. 8. The switch 436 is also coupled to a battery terminal 428 supported by the handle housing sections 422, 424 such that, when a battery is coupled to the tool 410, electrical power is supplied to the switch 436 via the battery terminal 428.

The handle assembly 412 further includes a motor housing 418 configured to support the motor 416 so that the output shaft 440 extends toward the work attachment 414 when the angle impact tool 410 is assembled as shown in FIG. 10. The motor 416 is secured within the motor housing 418 via mounting screws 445. The handle assembly 412 also includes a number of o-rings 434 that are positioned between the motor 416 and the motor housing 418 to radially stabilize the motor 416.

In the illustrative embodiment shown in FIGS. 9 and 10, the gear assembly 458 of the work attachment 414 includes a planetary gearset 570. The planetary gearset 570 includes a central or sun gear 572, a number of planet gears 574 arranged within a ring gear 576 so that each planet gear 574 meshes with both the sun gear 572 and the ring gear 576, and a planet carrier 578 coupled to each of the planet gears 574 and supporting each of the planet gears 574 for rotation. The sun gear 572 includes a shaft 430 that extends along the axis 442 and couples to the output shaft 440 of the motor 416 for rotation therewith. It should be appreciated that, in other embodiments, the planetary gearset 570 of the gear assembly 458 may have other configurations.

The gear assembly 458 further includes a bevel gear 462 having a shaft 489 that extends along the axis 442 and is coupled to the planet carrier 578 of the planetary gearset 570 for rotation therewith, as shown in FIGS. 9 and 10. The bevel gear 462 is supported for rotation about the axis 442 by a needle bearing 439 and a spindle bearing 495. The work attachment 414 also includes a spacer 437 positioned between the bearing 495 and the ring gear 576 of the planetary gearset 570, as shown in FIGS. 9 and 10.

The gear assembly 458 also includes a bevel gear 466 that meshes with the bevel gear 462. The bevel gear 466 is mounted on a shaft 468 for rotation therewith about an axis 463 that is perpendicular to the axis 442, as shown in FIG. 10. The shaft 468 is supported for rotation in the housing 446, 448 of the work attachment 414 by bearings 470*a*, 470*b* of the gear assembly 458. A spur gear 472 of the gear assembly 458 is mounted on the shaft 468 for rotation therewith, as shown in FIGS. 9 and 10.

The gear assembly 458 further includes a drive spur gear 484 that meshes with the spur gear 472, as shown in FIG. 10. The drive spur gear 484 is mounted on a camshaft 494 of the impact mechanism 460 for rotation therewith about the axis 486, and the camshaft 494 is supported for rotation in the housing 446, 448 of the work attachment 414 by a bearing 490*b*. Rotation of the drive spur gear 484 is transferred to the impact mechanism 460 to cause a hammer 400 of the impact mechanism 460 to rotate about the axis 486 (within a sleeve 464 that is sized to receive the hammer 400). As described above, this rotation of the hammer 400 results in periodic impacts between the hammer 400 and an anvil 411 of the impact mechanism 460, causing rotation of the anvil 411 (and, hence, the output drive 488) about the axis 486.

As shown in FIG. 9, the output drive 488 of the work attachment 414 is integrally formed with anvil jaws to create the anvil 411 of the impact mechanism 460. In other embodiments, the output drive 488 may be distinct from and coupled to the anvil 411 (such that rotation of the anvil 411 drives rotation of the output drive 488). In the illustrative embodiment, the anvil 411 (including the output drive 488) is supported for rotation relative to the housing body 446 by the bushing 490*a*. The output drive 488 may be configured to connect to a socket or other fastener-driving output element. In the illustrative embodiment, a resilient retainer 511 is positioned near an end of the output drive 488 opposite the anvil jaws, as shown in FIGS. 9 and 10. When a socket is connected to the output drive 488, the resilient retainer 511 may engage an internal surface or recess of the socket to maintain the socket in engagement with the output drive 488.

The impact mechanism 460 of the work attachment 414 may be embodied as any suitable type of impact mechanism. As shown in FIGS. 9 and 10, the impact mechanism 460 is illustratively embodied as a ball-and-cam-type impact mechanism with similar construction and operation to the impact mechanisms 60, 260 described above with reference to FIGS. 1-7 (except as noted below). For instance, the camshaft 494 and the hammer 400 of the impact mechanism 460 each include cam grooves defined therein that receive respective balls to couple the hammer 400 to the camshaft 494. The camshaft 494 is coupled to the drive spur gear 484 for rotation therewith. As shown in FIGS. 9 and 10, a key 447 is disposed between the camshaft 494 and the drive spur gear 484, and a retaining ring 449 is also used to maintain the position the drive spur gear 484 on the camshaft 494.

As illustrated in FIGS. 9 and 10, the work attachment 414 includes a conical spring 506 positioned between the drive spur gear 484 and the hammer 400 of the impact mechanism 460 (rather than a cylindrical spring, like the springs 106, 306 positioned between the drive spur gears 84, 284 and the hammers 100, 300 of the impact mechanisms 60, 260). The conical spring 506 biases the hammer 400 away from the drive spur gear 484 (such that hammer jaws of the hammer 400 are moved into engagement with the anvil jaws of the anvil 411). The conical spring 506 surrounds a portion of the camshaft 494.

As best seen in FIG. 10, the conical spring 506 has a generally conical (or frusto-conical) cross-section. In other words, one end of the conical spring 506 is wider, or has a larger diameter, than the opposite end of the conical spring 506. In the illustrative embodiment, an end of the conical spring 506 that is coupled to the drive spur gear 484 has a smaller diameter than an opposite end of the conical spring 506 that is coupled to the hammer 400. It is contemplated that, in other embodiments, the end of the conical spring 506 that is coupled to the drive spur gear 484 may have a larger smaller diameter than the opposite end of the conical spring 506 that is coupled to the hammer 400.

In the illustrated embodiment, the conical spring 506 rotates with the drive spur gear 484, and a washer 452 and a plurality of thrust balls 456 cooperate to form a bearing 490*c* that permits the hammer 400 to rotate about the axis 486 with respect to the conical spring 506. In other embodiments, the conical spring 506 may rotate with the hammer 400 and a bearing may permit the drive spur gear 484 to rotate with respect to the conical spring 506.

It is believed that the conical spring 506 may provide several advantages over the cylindrical springs 106, 306. For instance, the conical spring 506 may have a longer service life than the cylindrical springs 106, 306. The conical spring 506 may also have a smaller solid height than the cylindrical springs 106, 306, while maintaining similar performance. Decreasing the solid height of the conical spring 506 may allow for a decrease in the overall height of the work attachment 414. In the illustrative embodiment of FIG. 9, the smaller diameter of the end of the conical spring 506 coupled to the drive spur gear 484 may also allow the drive spur gear 484 to have a smaller diameter, further decreasing the dimensions of the work attachment 414.

As shown in FIG. 9 (and discussed in detail above), the housing 446, 448 of the work attachment 414 is partitioned into the housing body 446 and the housing cap 448. When the housing cap 448 is removably coupled to the housing body 446 using the fasteners 450, a gasket 457 is positioned between the housing body 446 and the housing cap 448 to provide a fluid seal for the housing 446, 448.

As shown in FIGS. 9-11, the housing body 446 is formed to include a bore 459 that extends along the axis 442, a bore 461 that extends along the axis 486, and a bore 465 that extends along the axis 463. As discussed above, in the illustrative embodiment of FIGS. 8-12, the axes 463, 486 are parallel to one another and each perpendicular to the axis 442. The bore 465 is positioned between the bores 459 and 461, such that the bore 465 overlaps each of the bore 459 and the bore 461. In other words, in the illustrative embodiment, the bore 465 is in direct fluid communication with both the bore 459 and the bore 461. When the work attachment 414 is assembled and the housing cap 448 is removably coupled to the housing body 446 (as shown in FIG. 10), the impact mechanism 460 is positioned in the bore 461 and the gear assembly 458 is positioned primarily within the bores 459, 465 (though the drive spur gear 484 of the gear assembly 458 is also positioned in the bore 461).

As best seen in the cross-sectional view of FIG. 10, the bore 459 is formed in the housing body 446 such that the bore 459 includes several bore sections having differing diameters from one another. More specifically, the bore 459 includes a bore section 477, a bore section 479, a bore section 481, and a bore section 483, each of which has a successively smaller diameter than the previous section (moving from the rear end 520 of the work attachment 414 toward the front end 522 of the work attachment 414). Each of the bore sections of bore 459, and the components positioned therein when the work attachment 414 is assembled (as shown in FIG. 10) are discussed in more detail below.

The ring gear 576 of the planetary gearset 570 is positioned in the bore section 477 of the bore 459, as shown in FIG. 10. The bore section 477 is bounded by an internal surface 485 of the housing body 446 that defines a diameter of the bore section 477. The ring gear 576 is engaged with the internal surface 485 such that the ring gear 576 is fixed relative to the housing body 446. As shown in FIG. 10, the sun gear 572, the planet gears 574, the planet carrier 578, and a section 508 of the shaft 489 of the bevel gear 462 are also each at least partially positioned in the bore section 477.

The spacer 437 is positioned in the bore section 479 between the ring gear 576 and the bearing 495. The bore section 479 is bounded by an internal surface 487 of the housing body 446 that defines a diameter of the bore section 479. The diameter of the bore section 479 is less than the diameter of the bore section 477. The spacer 437 is positioned in the bore section 479 such that the spacer 437 is engaged with the internal surface 487. The section 508 of the shaft 489 of the bevel gear 462 extends through the bore section 479 along the axis 442.

The bearing 495 is positioned in the bore section 481 between the spacer 437 and the bearing 439. The bore section 481 is bounded by an internal surface 491 of the housing body 446 that defines a diameter of the bore section 481. The diameter of the bore section 481 is less than the diameter of the bore section 479. The section 508 of the shaft 489 of the bevel gear 462 also extends through the bore section 481 along the axis 442. The bearing 495 engages both the internal surface 491 and the section 508 of the shaft 489 to support the bevel gear 462 for rotation about the axis 442.

The bearing 439 is positioned in the bore section 483 between the bearing 495 and the bore 465, as shown in FIG. 10. The bore section 483 is bounded by an internal surface 510 of the housing body 446 that defines a diameter of the bore section 483. The diameter of the bore section 483 is less than the diameter of the bore section 481. A section 512 of the shaft 489 of the bevel gear 462 extends through the bore section 483 along the axis 442. A diameter of the section 512 of the shaft 489 is greater than a diameter of the section 508 of the shaft 489 discussed above. The bearing 439 engages both the internal surface 510 and the section 512 of the shaft 489 to support the bevel gear 462 for rotation about the axis 442. As shown in FIG. 10, the bearing 495 (positioned in the bore section 481) abuts both the section 512 of the shaft 489 and the internal surface 510 of the housing body 446, which serves to properly align the bevel gears 462, 466.

During operation of the tool 410, rotation of the output shaft 440 of the motor 416 will be transferred to the sun gear 572 (via the shaft 430 of the sun gear 572). Rotation of the sun gear 572 relative to the ring gear 576 will cause the planet gears 574 to travel about the sun gear 572. Travel of the planet gears 574 causes rotation of the planet carrier 578 which is coupled to the bevel gear 462 such that rotation of the planet carrier 578 drives rotation of the bevel gear 462.

The bevel gear 462 extends along the axis 442 into the bore 465 such that the bevel gear 462 meshes with the bevel gear 466 positioned in the bore 465. The bevel gear 466 is coupled to an end 513 of the shaft 468 for rotation therewith about the axis 463. The end 513 of the shaft 468 is supported for rotation in the bore 465 by the bearing **470*b*. The shaft 468 extends through the bore 465 along the axis 463 to an end 515 opposite the end 513. The spur gear 472 is coupled to the end 515 of the shaft 468 for rotation therewith about the axis 463. The end 515 of the shaft 468 is supported for rotation by the bearing 470*a***.

Figure 12:
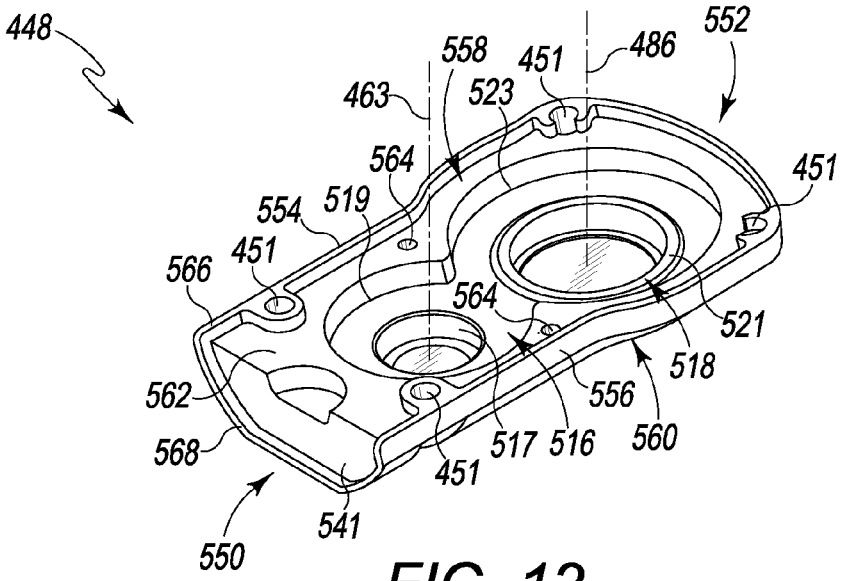
FIG. 12 is a perspective view of a housing cap of the work attachment of the angle impact tool of FIG. 8.

As best seen in FIG. 12, the housing cap 448 is formed to include a bore 516 that extends along the axis 463 when the housing cap 448 is removably coupled to the housing body 446. As such, when the housing cap 448 is removably coupled to the housing body 446 as shown in FIG. 10, the bore 465 is aligned with the bore 516 such that the bearing **470*a* and the spur gear 472 are received in the bore 516**.

During operation of the tool 410, rotation of the bevel gear 462 about the axis 442 will drive rotation of the bevel gear 466 about the axis 463. Rotation of the bevel gear 466 causes the shaft 468 to rotate about the axis 463, thereby causing the spur gear 472 to rotate about the axis 463.

In the illustrative embodiment, the impact mechanism 460 is positioned in the bore 461 such that a portion of the anvil 411 including the output drive 488 extends along the axis 486 through a bottom face 530 of the housing body 446 to a point outside of the housing body 446. As discussed above, the anvil 411 (including the output drive 488) is supported for rotation about the axis 486 by the bushing **490*a* which is positioned adjacent the bottom face 530 of the housing body 446, as shown in FIG. 10. The hammer 400 is coupled for rotation with the camshaft 494 about the axis 486, and the camshaft 494 is supported for rotation about the axis 496 by the bearing 490*b***.

As best seen in FIG. 12, the housing cap 448 is formed to include a bore 518 that extends along the axis 486 when the housing cap 448 is removably coupled to the housing body 446. As such, when the housing cap 448 is removably coupled to the housing body 446 as shown in FIG. 10, the bore 461 is aligned with the bore 518 such that the bearing **490*b* and the drive spur gear 484 are received in the bore 518**.

During operation of the tool 410, rotation of the spur gear 472 about the axis 463 drives rotation of the drive spur gear 484 about the axis 486. Rotation of the drive spur gear 484 causes the camshaft 494 to rotate about the axis 486, thereby causing the hammer 400 to rotate about the axis 486. As discussed above, as the hammer 400 rotates about the axis 486, the hammer 400 also reciprocally translates along the axis 486 to periodically deliver an impact load to the anvil 411. These impact blows cause intermittent rotation of the anvil 411 and, hence, the output drive 488.

Referring now to FIG. 11, the housing body 446 is shown in a detailed perspective view (without the remaining components of the work attachment 414). As mentioned above, the housing body 446 includes a rear end 520 configured to couple to the handle assembly 412 and a front end 522 opposite the rear end 520. As shown in FIG. 11, and discussed in greater detail below, the housing body 446 also includes a side 524, a side 526, a top face 528, and the bottom face 530 as shown in FIG. 11.

The rear end 520 of the housing body 446 includes a receiving surface 532 defining an exterior profile 533 and a coupling surface 534 that is recessed from the exterior profile 533 such that the coupling surface 534 does not extend beyond the exterior profile 533. The receiving surface 532 interconnects with the coupling surface 534, as shown in FIG. 11. The rear end 520 is configured to couple to the handle assembly 412 such that the handle housing sections 422, 424 of the handle assembly 412 extend past the receiving surface 532 to engage the coupling surface 534 to permit the housing body 446 to be coupled to the handle assembly 412 using the plurality of fasteners 497. As shown in FIG. 11, the bore 459 is formed in the coupling surface 534 such that the bore 459 extends along the axis 442.

The front end 522 of the housing body 446 is arranged in closer proximity to the bore 461 than the rear end 520, as shown in FIG. 11. The bore 459 extends from the rear end 520 along the axis 442 toward the front end 522 and overlaps the bore 465, as shown in FIGS. 10 and 11. The sides 524, 526 of the housing body 446 are arranged opposite one another and, in the illustrative embodiments, are mirror images of one another. Each of the sides 524, 526 interconnects with each of the ends 520, 522.

The bottom face 530 of the housing body 446 is interconnected with each of the ends 520, 522 and each of the sides 524, 526. In the illustrative embodiment, the bore 461 extends through the bottom face 530 along the axis 486, while the bore 465 does not extend through the bottom face 530. The top face 528 of the housing body 446 is arranged opposite the bottom face 530. The top face 528 interconnects with each of the ends 520, 522 and each of the sides 524, 526. The top face 528 includes a section 536 that interconnects with the rear end 520 and a section 538 that interconnects with the front end 522. As shown in FIG. 11, the sections 536, 538 interconnect with one another.

The section 536 of the top face 528 of the housing body 446 includes a surface 540 that extends from the rear end 520 toward the section 538. The section 536 also includes a surface 542 that interconnects with the surface 540 and extends parallel to the axes 463, 486 and perpendicular to the axis 442 (i.e., along the parting plane 425) to connect with the section 538. The apertures 499 discussed above are formed in the surface 540 such that the apertures 499 extend through the coupling surface 534 of the rear end 520 of the housing body 446, as shown in FIG. 11. Similar to the bores of the handle assembly 412 that receive the fasteners 497 when the handle assembly 412 is coupled to the housing body 446, each of the apertures 499 formed in the surface 540 extends at an acute angle relative to the axis 442. As such, a cutout section 544 is formed in the surface 540 adjacent to each of the apertures 499.

The section 538 of the top face 528 of the housing body 446 includes a surface 546 that is coupled to the surface 542 and extends perpendicular to the axes 463, 486 and parallel to the axis 442 (i.e., along the parting plane 423) toward the front end 522. The surface 546 is positioned closer to the axis 442 than the surface 540, as shown in FIG. 11. The bores 465, 461 extend through the surface 546 along the axes 463, 486, respectively. In the illustrative embodiment, four bores 453 formed in the housing body 446 also extend through the surface 546. As discussed above, the bores 453 are configured to receive fasteners 450 that removably couple the housing cap 448 to the housing body 446.

In the illustrative embodiment shown in FIG. 11, the section 538 of the top face 528 of the housing body 446 also includes a shoulder 548 that protrudes from the surface 546 in a direction parallel to the axes 463, 486 and away from the axis 442. Likewise, the section 536 of the top face 528 of the housing body 446 includes a shoulder 549 that protrudes from the surface 542 in a direction parallel to the axis 442 and toward the axes 463, 486. In other words, the shoulders 548, 549 of the housing body 446 each protrude toward the housing cap 448 when the housing 446, 448 is assembled (see FIG. 10).

Referring now to FIG. 12, the housing cap 448 is shown in a detailed perspective view (without the remaining components of the work attachment 414). The housing cap 448 includes a rear end 550, an front end 552, a side 554, a side 556, a bottom face 558, and a top face 560. The rear end 550 of the housing cap 448 includes a surface 541 that is configured to engage the shoulder 549 of the housing body 446 when the housing cap 448 is removably coupled to the housing body 446. The rear end 550 of the housing cap 448 also includes a lip 568 that protrudes from the surface 541 in a direction parallel to the axis 442 (when the housing cap 448 is removably coupled to the housing body 446) and away from the axes 463, 486. The lip 568 is configured to engage the surface 542 of the housing body 446 when the housing cap 448 is removably coupled to the housing body 446. In particular, the lip 568 of the housing cap 448 abuts the surface 542 of the housing body 446 along the parting plane 425. The front end 552 of the housing cap 448 is arranged opposite the rear end 550 such that the front end 552 is aligned with the front end 522 of the housing body 446 when the housing cap 448 is removably coupled to the housing body 446.

The bottom face 558 of the housing cap 448 is configured to abut the section 538 of the top face 528 of the housing body 446 when the housing cap 448 is removably coupled to the housing body 446. The bottom face 558 of the housing cap 448 includes a surface 562 that is coupled to the surface 541 and extends perpendicular to the axes 463, 486. The surface 562 is configured to engage the shoulder 548 of the housing body 446 when the housing cap 448 is removably coupled to the housing body 446. The bottom face 558 of the housing cap 448 also includes a lip 566 that protrudes from the surface 562 in a direction parallel to the axes 463, 486 and toward the axis 442 (when the housing cap 448 is removably coupled to the housing body 446). In other words, the lip 566 (as well as the lip 568) of the housing cap 448 protrudes toward the housing body 446 when the housing 446, 448 is assembled (see FIG. 10). The lip 566 is configured to engage the surface 546 of the housing body 446 when the housing cap 448 is removably coupled to the housing body 446. In particular, the lip 566 of the housing cap 448 abuts the surface 546 of the housing body 446 along the parting plane 423.

The bottom face 558 is formed to include the bores 516, 518 described above. The bore 516 includes a bore section 517 sized to receive the bearing 470*a* and a bore section 519 sized to receive the spur gear 472. The bore 518 includes a bore section 521 sized to receive the bearing 490*b* and a bore section 523 sized to receive the drive spur gear 484. When the housing 446, 448 is assembled, the lips 566, 568 engage the corresponding shoulders 548, 549 such that the bores 461, 518 are aligned with one another and the bores 465, 516 are aligned with one another. The apertures 451 (which receive the fasteners 450, as discussed above) are formed in the lip 566 such that the plurality of apertures 451 extend from the bottom face 558 to the top face 560, as shown in FIG. 12.

In the illustrative embodiment, the work attachment 414 also includes a number of alignment pins 473 (FIG. 9). As shown in FIG. 11, the housing body 446 includes a corresponding number of non-threaded bores 454. Similarly, as shown in FIG. 12, the housing cap 448 includes a corresponding number of non-threaded bores 564. When the housing cap 448 is brought into engagement with the housing body 446, each of the alignment pins 473 is received in a corresponding bore 454 of the housing body 446 and a corresponding bore 564 of the housing cap 448. In this embodiment, the pins 473 will align the bores 461, 518 and will align the bores 465, 516 while the housing cap 448 is removably coupled to the housing cap 448.

Head height dimensions 114, 314, 614 of the work attachments 14, 214, 414 are illustrated in FIGS. 4, 7, and 10, respectively. The head height dimension 114, 314, 614 is the distance (measured parallel to the output axis 86, 286, 486) from the top of the housing cap 48, 248, 448 to the bottom of the housing body 46, 246, 446. The motor housings 18, 218, 418 define analogous motor housing height dimensions 118, 318, 618, as shown in FIGS. 4, 7, and 10. It may be desirable to reduce the head height dimensions 114, 314, 614 so that the work attachments 14, 214, 414 can fit into small spaces. As suggested in the drawings, the illustrative embodiments of the present disclosure allow the head height dimensions 114, 314, 614 to be equal to or smaller than the corresponding motor housing height dimensions 118, 318, 618. Such configurations permit insertion of the angle impact tools into smaller spaces than has previously been achievable, without compromising torque.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An angle impact tool comprising:

a handle assembly extending along a first axis and supporting a motor, the motor including a shaft configured to rotate about the first axis;

a work attachment coupled to the handle assembly, the work attachment comprising:

an impact mechanism including an anvil configured to rotate about a second axis that is non-parallel to the first axis and a hammer configured to rotate about the second axis to periodically deliver an impact load to the anvil to cause rotation of the anvil about the second axis;

a gear assembly configured to transfer rotation from the shaft of the motor to the hammer of the impact mechanism;

a housing supporting the impact mechanism and the gear assembly, wherein the housing is partitioned along a first parting plane that is perpendicular to the second axis such that the housing includes a first housing section and a second housing section;

wherein the first axis is parallel to the first parting plane; and wherein the first and second housing sections are also partitioned along a second parting plane that is perpendicular to the first axis.

2. The angle impact tool of claim 1, wherein the first axis lies in the first parting plane.

3. The angle impact tool of claim 1, wherein the first axis is spaced apart from the first parting plane.

4. The angle impact tool of claim 3, wherein the first axis intersects the second axis between (i) a position of the anvil along the second axis and (ii) a point at which the second axis intersects the first parting plane.

5. The angle impact tool of claim 3, wherein the first parting plane intersects the second axis between (i) a position of the anvil along the second axis and (ii) a point at which the second axis intersects the first axis.

6. The angle impact tool of claim 1, wherein the second housing section is removably coupled to the first housing section by a plurality of fasteners, each of the plurality of fasteners extending through a corresponding aperture formed in the second housing section and being received in a corresponding bore formed in the first housing section.

7. The angle impact tool of claim 6, wherein each of the corresponding apertures formed in the second housing section is recessed from an exterior profile of the second housing section such that each of the plurality of fasteners that removably couples the second housing section to the first housing section does not extend beyond the exterior profile of the second housing section.

8. The angle impact tool of claim 6, further comprising a gasket positioned between the first and second housing sections to provide a fluid seal when the second housing section is removably coupled to the first housing section by the plurality of fasteners.

9. The angle impact tool of claim 1, wherein:

the first housing section is formed to include a first bore extending along the first axis, a second bore extending along the second axis, and a third bore extending along a third axis that is parallel to the second axis, the third bore being positioned between the first and second bores and overlapping both the first and second bores;

the impact mechanism is positioned in the second bore; and the gear assembly is positioned at least partially within the first and third bores.

10. The angle impact tool of claim 9, wherein the second housing section is formed to include a fourth bore extending along the second axis and a fifth bore extending along the third axis.

11. The angle impact tool of claim 10, wherein the work attachment further comprises a plurality of pins that each extend into a corresponding bore formed in the first housing section and into a corresponding bore formed in the second housing section such that the plurality of pins align the fourth bore with the second bore and the fifth bore with the third bore.

12. The angle impact tool of claim 10, wherein:

the first housing section is formed to include a shoulder that protrudes toward the second housing section; and the second housing section is formed to include a lip that protrudes toward the first housing section, the lip engaging the shoulder such that the fourth bore is aligned with the second bore and the fifth bore is aligned with the third bore.

13. The angle impact tool of claim 9, wherein the gear assembly includes (i) a first bevel gear positioned in the first bore of the first housing section and configured to rotate about the first axis and (ii) a second bevel gear positioned in the third bore of the first housing section and configured to rotate about the third axis, and wherein the second bevel gear meshes with the first bevel gear.

14. The angle impact tool of claim 13, wherein:

the first bore comprises adjacent first and second bore sections, the second bore section having a smaller diameter than the first bore section and being located closer to the third bore than the first bore section, the first bore section being bounded by a first internal surface of the first housing section, the second bore section being bounded by a second internal surface of the first housing section;

the first bevel gear includes a shaft that extends along the first axis and comprises adjacent first and second shaft sections, the second shaft section having a larger diameter than the first shaft section, the first shaft section being positioned within the first bore section, the second shaft section being positioned within the second bore section; and a bearing that supports the first bevel gear for rotation about the first axis and engages both the first shaft section and the first internal surface abuts both the second shaft section and the second internal surface to align the first and second bevel gears.

15. The angle impact tool of claim 1, wherein the work attachment is removably coupled to the handle assembly by a plurality of fasteners, each of the plurality of fasteners extending through a corresponding aperture formed in the first housing section and being received in a corresponding bore formed in the handle assembly, each corresponding bore extending along an axis that is disposed at an acute angle to the first axis.

16. A work attachment comprising:

a housing body configured to be coupled to a motorized tool including a rotatable output shaft, the housing body being formed to include (i) a first bore extending along a first axis, (ii) a second bore extending along a second axis that is perpendicular to the first axis, and (iii) a third bore extending along a third axis that is perpendicular to the first axis, wherein the third bore is positioned between the first and second bores and overlaps both the first and second bores;

an impact mechanism received in the second bore of the housing body, the impact mechanism including a hammer configured to rotate about the second axis to periodically deliver an impact load to an anvil to cause rotation of the anvil about the second axis;

a gear assembly received at least partially in the first and third bores of the housing body, the gear assembly configured to be coupled to the rotatable output shaft of the motorized tool such that rotation of the output shaft about the first axis drives rotation of the hammer about the second axis;

a housing cap removably coupled to the housing body by a plurality of fasteners to enclose the second and third bores, the housing cap abutting the housing body along a first parting plane that is perpendicular to the second and third axes; and wherein the housing cap also abuts the housing body along a second parting plane that is perpendicular to the first axis.

17. The work attachment of claim 16, wherein the second parting plane is located between the third axis and an end of the housing body configured to be coupled to the motorized tool.

* * * * *